US007600344B2

(12) United States Patent
Michaud

(10) Patent No.: US 7,600,344 B2
(45) Date of Patent: Oct. 13, 2009

(54) BRAKE DEVICE WITH INTEGRATED ANTI-THEFT MECHANISM FOR GARAGE DOORS AND THE LIKE, AND DOOR ASSEMBLY INCLUDING THE SAME

(75) Inventor: Stéphane Michaud, St-Nicéphore (CA)

(73) Assignee: Canimex, Inc., Drummondville, Quebec (CA)

( * ) Notice: Subject to any disclaimer, the term of this patent is extended or adjusted under 35 U.S.C. 154(b) by 253 days.

(21) Appl. No.: 11/801,255

(22) Filed: May 8, 2007

(65) Prior Publication Data

US 2008/0023603 A1 Jan. 31, 2008

Related U.S. Application Data

(60) Provisional application No. 60/798,305, filed on May 8, 2006.

(51) Int. Cl.
*E05D 15/10* (2006.01)

(52) U.S. Cl. ..... 49/322

(58) Field of Classification Search ..... 49/322, 49/197, 199, 200; 160/188, 189; 292/DIG. 36, 292/DIG. 65, DIG. 15, 194, 202, 203, 210, 292/304

See application file for complete search history.

(56) References Cited

U.S. PATENT DOCUMENTS 1,404,053 A * 1/1922 Peelle ..... 160/193
2,274,552 A * 2/1942 Kingsland ..... 49/322
3,276,165 A * 10/1966 Purcell ..... 49/322
3,704,548 A 12/1972 Wiegleb
4,385,471 A 5/1983 Gabry et al.
4,442,631 A 4/1984 Weber
4,472,910 A 9/1984 Iha
4,618,177 A 10/1986 Schultz
4,805,344 A 2/1989 Hrboka
4,836,589 A 6/1989 Mohr
4,996,795 A 3/1991 Niswonger
5,090,522 A 2/1992 Korff
5,291,686 A 3/1994 Sears et al.
5,343,923 A 9/1994 Keller
5,489,130 A 2/1996 Clark (Continued)

FOREIGN PATENT DOCUMENTS

CA 1108198 9/1981

(Continued)

*Primary Examiner*—Jerry Redman
(74) *Attorney, Agent, or Firm*—Merchant & Gould P.C.

(57) ABSTRACT

A brake device for a cable-operated door operated by a tension cable, being mountable onto the cable-operated door and configured for cooperating with the tension cable so as to immobilize the cable-operated door with respect to the fixed structure by a braking arm in the event of a loss of tension in the cable. The brake device is provided with an anti-theft mechanism including a catcher assembly and a protrusion operatively projecting from the braking arm. The catcher assembly is operatively connectable to the fixed structure and the protrusion is shaped, positioned and sized with respect to the catcher assembly so as to be engaged with the catcher assembly when the braking arm is operated into the engaged configuration caused by a given loss of tension in the cable, thereby preventing the cable-operated door from being displaced upwardly along the fixed structure as a result of the catcher assembly abutting against the protrusion of the braking arm.

29 Claims, 40 Drawing Sheets

U.S. PATENT DOCUMENTS

| | | | | |
|---|---|---|---|---|
| 5,544,924 | A | 8/1996 | Paster | |
| 5,581,939 | A | 12/1996 | Regan et al. | |
| 5,698,073 | A | 12/1997 | Vincenzi | |
| 6,089,626 | A | 7/2000 | Shoemaker | |
| 6,145,570 | A | 11/2000 | Mullet et al. | |
| 6,179,036 | B1 | 1/2001 | Harvey | |
| 6,189,266 | B1 | 2/2001 | Mihalcheon | |
| 6,279,268 | B1 | 8/2001 | Beaudoin et al. | |
| 6,553,716 | B2 | 4/2003 | Bruns | |
| 6,640,496 | B2 | 11/2003 | Mullet | |
| 6,715,236 | B2 | 4/2004 | Mullet | |
| 6,782,662 | B2 | 8/2004 | McCartney et al. | |
| 6,880,609 | B2 | 4/2005 | Mullet et al. | |
| 6,928,696 | B2 | 8/2005 | Wartman | |
| 7,000,354 | B2 | 2/2006 | Beaudoin et al. | |
| 7,048,029 | B2 | 5/2006 | Rieder et al. | |
| 7,097,003 | B2 * | 8/2006 | Reynolds et al. | 187/351 |
| 7,114,753 | B2 | 10/2006 | Nodorft | |
| 7,350,333 | B2 * | 4/2008 | Michaud et al. | 49/322 |
| 7,484,332 | B2 * | 2/2009 | Hormann et al. | 49/322 |
| 2002/0117787 | A1 | 8/2002 | Beaudoin et al. | |
| 2002/0184824 | A1 * | 12/2002 | McCartney et al. | 49/322 |
| 2003/0000655 | A1 | 1/2003 | Martin | |
| 2003/0041520 | A1 * | 3/2003 | Mullet | 49/322 |
| 2003/0051409 | A1 * | 3/2003 | Bruns | 49/322 |
| 2004/0182007 | A1 * | 9/2004 | Beaudoin et al. | 49/322 |
| 2004/0212197 | A1 | 10/2004 | Shoemaker | |
| 2005/0183341 | A1 | 8/2005 | Michaud et al. | |
| 2006/0011312 | A1 | 1/2006 | Diaz et al. | |
| 2006/0118253 | A1 | 6/2006 | Slusarski et al. | |
| 2008/0023603 | A1 * | 1/2008 | Michaud | 248/222.51 |

FOREIGN PATENT DOCUMENTS

| | | | |
|---|---|---|---|
| DE | 27 35 123 | A1 | 2/1979 |
| DE | 3427 105 | A1 | 1/1986 |
| DE | 44 28 034 | C1 | 11/1995 |
| EP | 0 729 539 | B1 | 9/1996 |
| FR | 2 697 570 | A1 | 5/1994 |
| WO | WO 9605395 | A1 | 8/1995 |
| WO | WO 02/008260 | A1 | 10/2002 |

* cited by examiner

BRAKE DEVICE WITH INTEGRATED ANTI-THEFT MECHANISM FOR GARAGE DOORS AND THE LIKE, AND DOOR ASSEMBLY INCLUDING THE SAME

FIELD OF THE INVENTION

The present invention relates to a brake device, also commonly known in the industry as a "stop bottom bracket", and also relates to a door assembly including the same. More particularly, the present invention relates to a braking device with an integrated anti-theft mechanism for use with a cable-operated door, such as garage doors and the like, and is used to not only reduce the risk of the garage door falling, or at the very least slow down its descent, in case of a rupture of one of the cables or in case of a failure of one of the elements (e.g. spring) of the counterbalancing mechanism that holds the cables and/or operates the door, these cases being generally represented by a loss of tension in a given cable, but is also configured namely to prevent the door assembly provided with the brake device with integrated anti-theft mechanism from being opened by an unauthorized user.

BACKGROUND OF THE INVENTION

Cable-operated doors such as garage doors are well known in the art. A garage door is usually connected to an overhead counterbalancing mechanism that provides a counterbalancing force in order to decrease the force required to open the door and also facilitate its closing. A conventional garage door is typically connected to the counterbalancing mechanism by means of two cables, one at the right and one at the left. The cables are usually made of steel. The lower free end of each cable is usually attached at the bottom of the door.

It is also known in the art that a garage door needs to have a proper counterbalancing system so that it may be easily opened and closed. The counterbalancing force is generally achieved by the usage of either one or many torsional springs. Each torsional spring is generally connected to two plugs, a first one being the "winding plug" at one end of the spring, and a second one being the "stationary plug" at the other end of the spring. The winding plug is generally in turn fixed onto the shaft while the stationary plug is generally fixed onto a fixed structure, such as a bearing plate mounted to a wall for example. To transmit the force to the door, there are generally two drums on the shaft of the counterbalancing mechanism on which cables are installed. The extremities of these cables are generally fixed onto bottom brackets, one on each side (left and right) of the door, typically at the last or bottom panel of a sectional door for example.

One could envisage that, although very unlikely, it might happen that one of the elements (e.g. spring) of the counterbalancing mechanism which are operatively connected to the cables may undergo a failure, leading to the garage door falling, which is undesirable. There have been other attempts to come up with braking devices used in the event of a failure of a cable or of an element holding the same.

Known in the art are the following US and foreign patents/patent applications which describe various cable braking devices for garage doors and the like: U.S. Pat. No. 4,385,471; U.S. Pat. No. 5,090,522; U.S. Pat. No. 5,291,686; U.S. Pat. No. 5,581,939; U.S. Pat. No. 6,189,266 B1; U.S. Pat. No. 6,279,268 B1; U.S. Pat. No. 6,553,716 B2; U.S. Pat. No. 6,640,496 B2; U.S. Pat. No. 6,715,236 B2; U.S. Pat. No. 6,928,696 B2; U.S. Pat. No. 7,000,354 B2; US 2002/0117787 A1; US 2003/0000655 A1; DE 27 35 123 A1; and FR 2,697,570.

However, most of the devices comprise detecting means which detect a loss of tension in the cable by means of levers, linkages, and the like which are either displaced along the same direction of the cable or in a direction perpendicularly thereto, which does not always enable a direct and sudden braking capability upon detection of the loss of tension in the cable. Furthermore, in order to carry out their braking functions, most of the above-mentioned devices rely on cams, and the like, which are used to frictionally engage or clamp a given portion of a side rail so as to brake the cable-operated door with respect to such a fixed structure. However, the braking capabilities of such devices rely mainly on the particular shape and eccentricity of the given cam.

The Applicant of the present application has developed a device in order to overcome the above-mentioned prior art drawbacks, the device being described and illustrated in International Patent Application No. PCT/CA2005/000232 made public on Sep. 1, 2005 under publication No. WO 2005/080725 A1. Corresponding US patent application No. 2005/0183341 A1 made public on Aug. 25, 2005 is incorporated herein by reference.

Also known in the art are the following US and foreign patents/patent applications which describe various cable braking devices for garage doors and the like: U.S. Pat. Nos. 3,704,548; 4,442,631; 4,472,910; 4,618,177; 4,805,344; 4,836,589; 4,996,795; 5,343,923; 5,544,924; 6,089,626; 6,179,036 B1; 6,782,662 B2; 6,880,609 B2; 7,048,029 B2; 7,114,753 B2; 2006/0011312 A1; 2006/0118253 A1; WO 96/05395 A1; and EP 0,729,539 B1.

It is also known in the art that there are basically two (2) main models of electric operators used with door assemblies, namely, trolley and jackshaft models. A substantial problem or inconvenience (i.e. "prior art problem #1") associated namely with jackshafts, is that, in certain cases, they enable the corresponding door to be opened, which is undesirable, as explained hereinbelow.

Indeed, in regards to the trolley model, an arm is generally fixed on the door and the electric motor pulls on this arm to open the door. The geometry of this arm is typically made to prevent door opening when the door is totally closed ("self-locking"). However, a major drawback associated with this type of device is that ones is not able to open the door from the outside even if it is not locked.

In regards to the jackshaft model, an electric motor typically turns the counterbalancing shaft. The cable drums are fixed on this shaft, and cables connect the door to these drums, so when one turns the shaft, the door is moving. A major drawback associated with this model of operator is that one can lift the door from the outside if it is not locked, but if one wants to be able to use the operator from the outside, one won't want to lock the door.

Indeed, when one lifts the door from the outside, because the shaft is controlled by the operator, it does not turn, so the cables come loose, so a thief just has to simply lift the weight of the door panels. For a heavy door, the weight becomes an anti-thief by itself, but for a light weight door, it is easy to open it, which is undesirable for obvious reasons.

Therefore, there is a need to find a way to prevent a light weight door from being opened by un-authorized users when employed with a jackshaft type operator.

It is also known in the art that another substantial problem or inconvenience (i.e. "prior art problem #2") in the garage door industry is that sometimes, for different reasons, a bigger seal may be used on the bottom of the door. With this type of seal, it is possible that the seal touches the lintel (i.e. top of the wall opening) or the seals on the side of the door when the door opens. Therefore, there is a need to find a way to add clearance for a bigger seal.

It is also known in the art that another substantial problem or inconvenience (i.e. "prior art problem #3") in the garage door industry is that cable failure devices are designed to activate if a cable slack occurs. For standard lift doors (i.e. door for which there is horizontal tracks on which the door goes when opened), when almost all the door is standing on the horizontal track (totally opened position), then the cable tension becomes very low because the vertical residual weight of the door is very low. Therefore, some actual cable brake devices activate at this position (i.e. when door is totally opened) because of the cable slack that occurs at this position. Therefore, there is a need to find a way to prevent a cable failure device to activate at this position even if there is a cable slack.

It is also known in the art that cable adjustment on the bottom bracket (typically on the bottom of the door) helps to simplify the door installation because it allows the installer to make the cable length adjustment easily and securely. Some cable failure devices already have adjustments, however, a substantial problem or inconvenience (i.e. "prior art problem #4") known in the garage door industry and associated with these conventional adjustments is that they are generally not optimal in terms of simplicity, accuracy and cost-effectiveness, and therefore, there is a need for a better way of carrying out these adjustments.

Hence, in light of the above-discussed, there is a need for an improved brake device which would be able to overcome some of the aforementioned prior art problems and concerns.

SUMMARY OF THE INVENTION

The object of the present invention is to provide a brake device which, by virtue of its design and components, satisfies some of the above-mentioned needs, and which is thus an improvement over other related brake devices and/or methods known in the prior art.

In accordance with the present invention, the above object is achieved, as will be easily understood, with a device, such as the one briefly described herein, and such as the one exemplified in the accompanying drawings.

More particularly, according to the present invention, there is provided a brake device for a cable-operated door operated by a tensioned cable, the cable-operated door having a movement guided along a fixed structure, the fixed structure having an inner portion and an outer portion, the brake device being mountable onto the cable-operated door and being configured for cooperating with the tensioned cable so as to immobilize the cable-operated door with respect to the fixed structure in the event of a loss of tension in the cable, the brake device comprising:

a support bracket mountable onto a bottom portion of the cable-operated door, the support bracket comprising:

at least one hole for receiving each a corresponding fastener for securely mounting the support bracket onto the cable-operated door, and a connection point onto which an extremity of the tensioned cable is connected;

a guiding assembly operatively mounted onto the support bracket for travelling along the inner portion of the fixed structure so as to guide the movement of the cable-operated door along said fixed structure when the support bracket is mounted onto the bottom portion of the cable-operated door;

a braking assembly operatively mounted onto the support bracket for cooperating with the tensioned cable, the braking assembly comprising a swivel component pivotably mounted and movable about the support bracket, the swivel component having opposite first and second ends, the first end being provided with a braking arm, and the second end being provided with a lever portion positioned, shaped and sized about the support bracket for cooperating with the tensioned cable, the braking arm projecting out from the support bracket for positioning of said braking arm adjacent to the outer portion of the fixed structure, the braking arm being operable between a retracted configuration, where the braking arm is urged away from the fixed structure via a frictional engagement of the tensioned cable against the lever portion opposite to the braking arm on the swivel component, so as to allow the guiding assembly to guide the cable-operated door freely along the fixed structure, and an engaged configuration, caused by a given loss of tension in the cable resulting in a decrease of frictional engagement of the cable with the lever portion, where the braking arm is no longer urged away and thereby engages a portion of the outer portion of the fixed structure for braking movement of the cable-operated door with respect to the fixed structure;

biasing means operatively connected between the support bracket and the braking assembly for biasing the braking arm into an engaged configuration; and a guiding channel defined within the lever portion of the swivel component for guiding the tensioned cable about the braking assembly and onto the connection point of the support bracket;

the improvement wherein the brake device is provided with an anti-theft mechanism comprising:

a catcher assembly operatively connectable to the fixed structure; and a protrusion operatively projecting from the braking arm, the protrusion been shaped, positioned and sized with respect to the catcher assembly so as to be engaged with said catcher assembly when the braking arm is operated into the engaged configuration caused by a given loss of tension in the cable, thereby preventing the cable-operated door from being displaced upwardly along the fixed structure as a result of the catcher assembly abutting against the protrusion of the braking arm.

According to another aspect of the present invention, there is also provided a door assembly (e.g. a garage door) provided with the above-mentioned brake device.

According to yet another aspect of the present invention, there is also provided a method of operating the above-mentioned brake device and/or door assembly.

According to yet another aspect of the present invention, there is also provided a kit for assembling the above-mentioned brake device and/or door assembly.

According to yet another aspect of the present invention, there is also provided a method for assembling components of the above-mentioned kit.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

Figure 1:
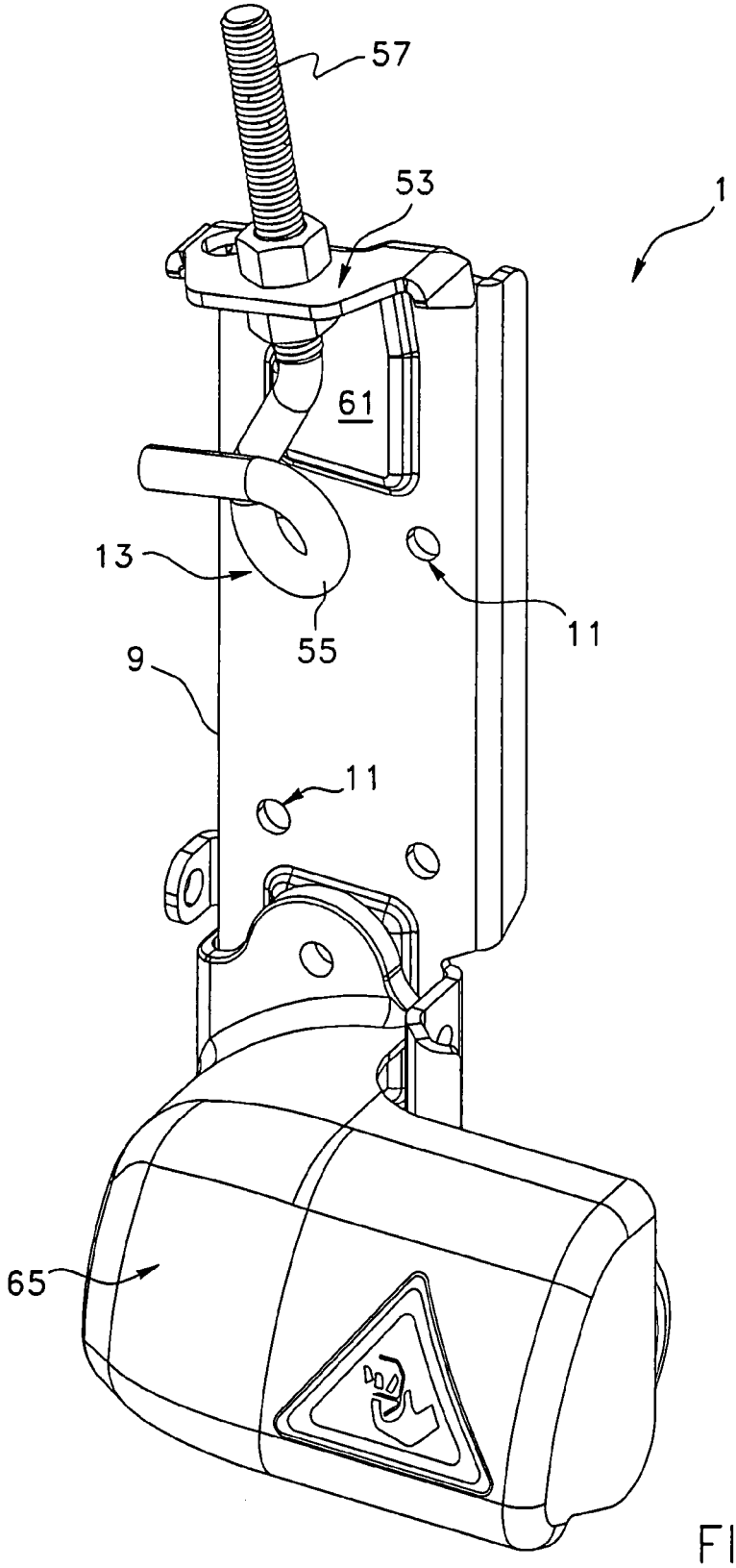
FIG. 1 (PRIOR ART)
FIG. 1 is a perspective view of a brake device according to the prior art.

In the following description, the same numerical references refer to similar elements. The embodiments shown in the figures are preferred, and are used for exemplification purposes only.

Moreover, although the present invention was primarily designed for use with a cable-operated door, such as a garage door assembly for example, it may be used with other types of doors and objects and in other fields, as apparent to a person skilled in the art. For this reason, expressions such as "cable", "garage", "door", etc., as used herein should not be taken as to limit the scope of the present invention and includes all other kinds of doors and/or items with which the present invention could be used and may be useful. Indeed, although the brake device with integrated anti-theft mechanism according to the present invention is preferably used in the garage door industry, it is to be understood by a person skilled in the art that it could be used for any other kind of door retained and operated by a cable and cooperating and being guided along a neighboring track system provided on its side, for example.

Moreover, in the context of the present invention, the expressions "brake device", "cable failure device", "stop bottom bracket", and any other equivalent expression known in the art will be used interchangeably. Furthermore, the same applies for any other mutually equivalent expressions, such as "cable-operated door" and "garage door", "braking arm" and "lever arm", as well as "braking" and "slowing down descent rate" for example, or even "track system", "guide rail" and "fixed structure", as also apparent to a person skilled in the art.

In addition, although the preferred embodiment of the present invention as illustrated in the accompanying drawings comprises various components such as a guiding channel 23, a roller 27, a shaft 29, a sleeve 31, a spring 63, a casing 65, etc., and although the preferred embodiment of the brake device 1 with integrated anti-theft mechanism 67 as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the brake device 1 with integrated anti-theft mechanism 67 and corresponding parts according to the present invention, as briefly explained and as can be easily inferred herefrom by a person skilled in the art, without departing from the scope of the invention.

Broadly described, the brake device 1 with integrated anti-theft mechanism 67 according to the present invention, as shown in the accompanying drawings, is a device 1 for use with a cable-operated door 3, such as garage doors 3 and the like, for providing advantages in that it is intended to slow down its descent, in the event of a failure in the counterbalancing mechanism of the cable-operated door 3, such as, for example, a rupture of one of the cables 5 or a failure of one of the elements (e.g. torsional spring) operatively connected to the cables 5, which is generally represented by a loss of tension in the given cable 5 operating the cable-operated door 3. The brake device 1 according to the present invention is intended to reduce the risk that the garage door 3 will fall, or at the very least, it will slow down its descent, so as to minimize the occurrence of damages to property, and the like.

Indeed, according to the present invention, the brake device 1 is intended for a cable-operated door 3 operated by a tensioned cable 5, the cable-operated door 3 having a movement guided along a fixed structure 7, such as a guide or side rail for example, as better shown in FIGS. 8-40, the fixed structure 7 having an inner portion 7*a* and an outer portion 7*b*. The brake device 1 is devised to be mountable onto the cable-operated door 3, at a suitable location thereon, such as a bottom portion thereof or a bottom panel of a sectional door 3 for example, and is configured for cooperating with the tensioned cable 5 so as to immobilize the cable-operated door 3 with respect to the fixed structure 7 in the event of a loss of tension in the cable 5, which represents typically a failure in the counterbalancing mechanism (see FIGS. 18 and 21) of the door 3 such as, as aforementioned, a rupture of one of the cables 5, a failure of one of the elements (for example, a torsional counterbalancing spring) operatively connected to the cables 5 of the counterbalancing mechanism, and/or other similar situations, as apparent to a person skilled in the art.

As better in the accompanying drawings, the brake device 1 comprises a support bracket 9, a guiding assembly 15, a braking assembly 17, biasing means 21, and a guiding channel 23.

Figure 2:
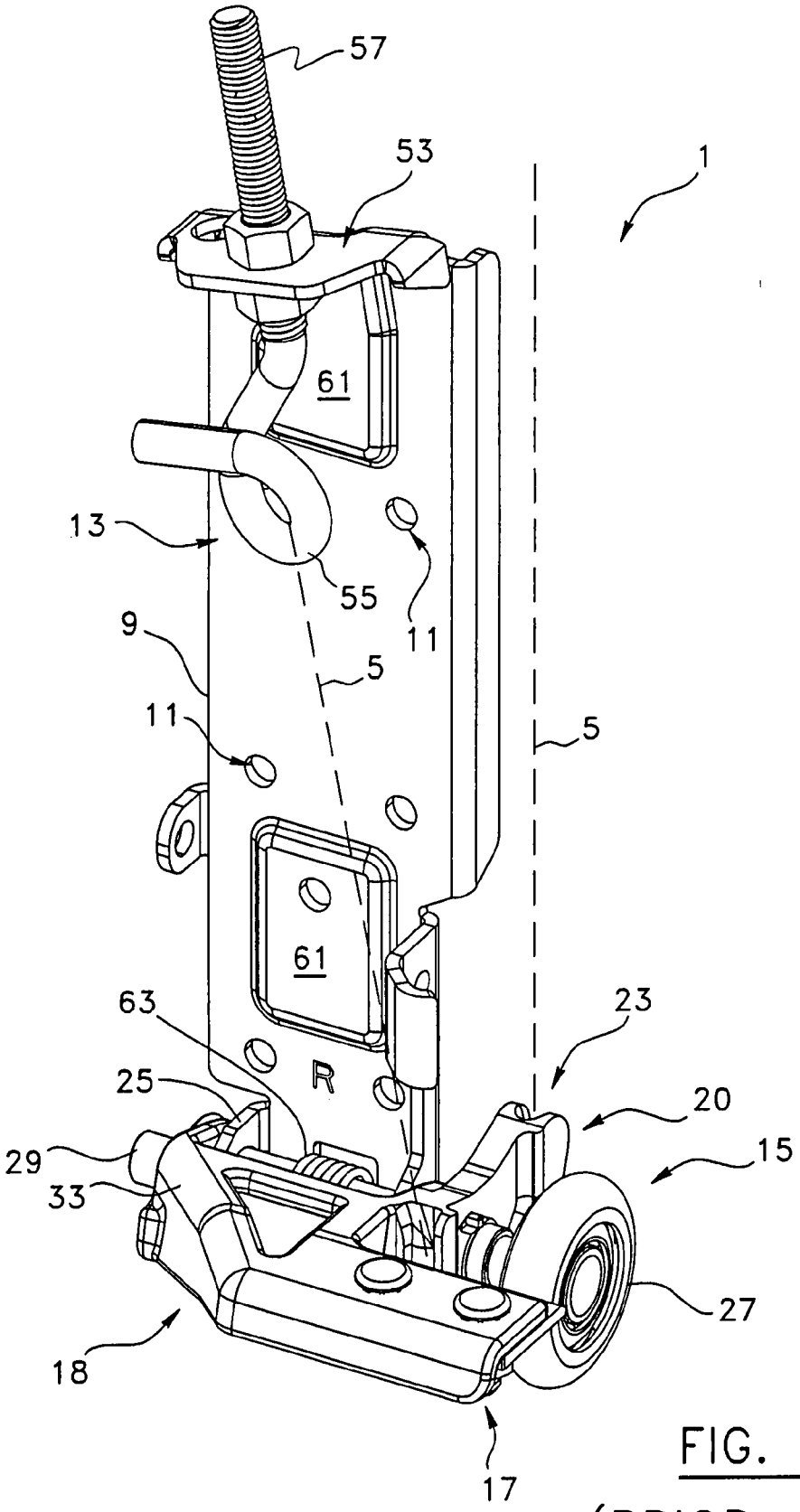
FIG. 2 (PRIOR ART)
FIG. 2 is another perspective view of what is shown in FIG. 1, the brake device being now shown without its protective casing, and cooperating with a tensioned cable represented schematically by a dotted line.
Figure 3:
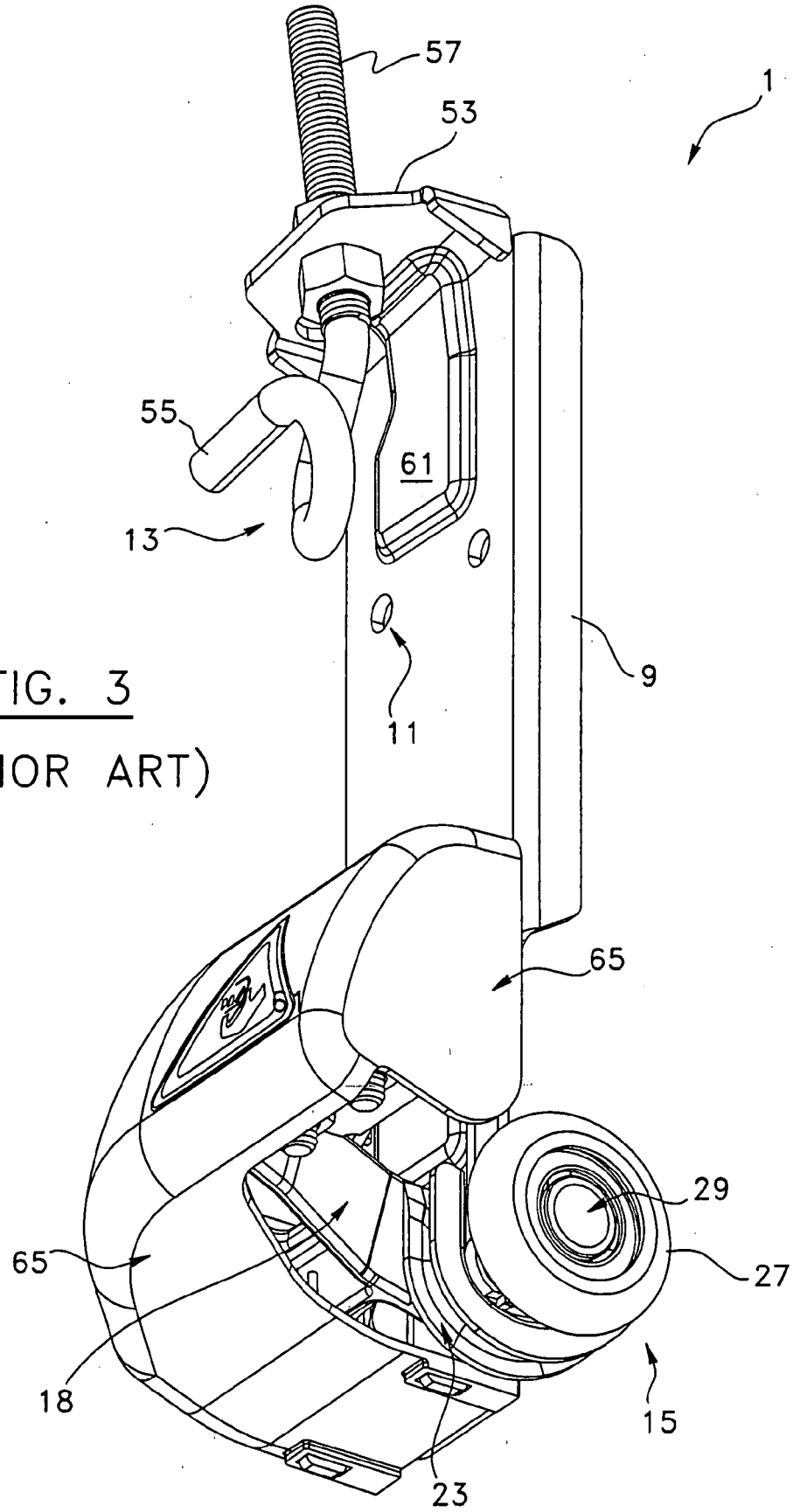
FIG. 3 (PRIOR ART)
FIG. 3 is a bottom perspective view of what is shown in FIG. 1.

The support bracket 9 is preferably mountable onto a bottom portion of the cable-operated door 3, such as the bottom panel of a sectional garage door for example, and preferably comprises at least one hole 11 for receiving each a corresponding fastener for securely mounting the support bracket 9 onto the cable-operated door 3, as can be easily understood when referring to FIGS. 8-21, and the support bracket 9 also preferably comprises a connection point 13 onto which an extremity of the tensioned cable 5 is connected. In FIG. 2 for example, the tensioned cable 5 has been represented schematically by a dotted line.

Preferably, and as shown in the accompanying drawings, the guiding assembly 15 according to the present invention is operatively mounted onto the support bracket 9 for traveling along the inner portion 7*a* of a fixed structure 7 so as to guide the movement of the cable-operated door 3 along said fixed structure 7 when the support bracket 9 is mounted onto the bottom portion of the cable-operated door 3. It is to be understood, as apparent to a person skilled in the art, that a conventional door usually has a plurality of guiding assemblies (e.g. rollers) for guiding the cable-operated door 3 along said fixed structure 7, such as a side rail for example, and that the brake device 1 according to the present invention is not absolutely necessary for guiding the cable-operated door 3 along said fixed structure 7, but preferably takes the place of a bottom guiding assembly which would otherwise be normally present in a conventional door, while at the same time providing safety advantages, as described herein.

As can be easily understood by a person skilled in the art when referring to the accompanying drawings, the braking assembly 17 of the present brake device 1 is operatively mounted onto the support bracket 9 thereof for cooperating with the tensioned cable. The braking assembly 17 comprises a swivel component 18 pivotably mounted and movable about the support bracket 9. This swivel component 18 has first and second opposite ends, the first end being provided with a braking arm 19, and the second end being provided with a lever portion 20, said lever portion 20 being positioned, shaped and sized about the support bracket 9 for cooperating with the tensioned cable 5. Preferably, the braking arm 19 and lever portion 20 are thus rigidly connected thereto, so that movement (i.e. rotation) of one causes an opposite movement of the other. They also preferably have a common pivot axis (i.e. pivot axis of shaft 29 and/or of sleeve 31, as explained hereinbelow), and are thus pivotally moveable with respect to the support bracket 9, as can be easily understood when contrasting FIGS. 8 and 10, for example. Moreover, as also shown, the braking arm 19 projects out from the support bracket 9 for positioning of the braking arm 19 adjacent to the outer portion 7*b* of the fixed structure 7, as also illustrated in the above-mentioned figures. The braking arm 19 is operable between a retracted configuration, better illustrated in FIGS. 8, 9, 13 and 14, and a braking or "engaged" configuration, as better illustrated in FIGS. 10, 11, 15 and 16. In the retracted configuration, the braking arm 19 is urged away from the fixed structure 7 via a frictional engagement of the tensioned cable 5 against the lever portion 20 opposite to the braking arm 19 on the swivel component 18, so as to allow the guiding assembly 15 to guide the cable-operated door 3 freely along the fixed structure 7. However, when in the braking or "engaged" configuration, caused by a loss of tension in the cable 5 resulting in a decrease of frictional engagement of the cable 5 with the lever portion 20, the braking arm 19 is no longer urged away, i.e. not biased anymore by the tensioned cable 5 pushing on the lever portion 20 and is thereby allowed to engage a portion of the outer portion 7*b* of the fixed structure 7 for braking movement of the cable-operated door 3 with respect to the structure, said engagement being driven not only by the design and the nature of the braking arm 19, as will be explained in greater detail hereinbelow, but also driven by biasing means 21, as also described hereinbelow, and as apparent to a person skilled in the art.

Indeed, the biasing means 21 are operatively connected between the support bracket 9 and the braking assembly 17 for biasing the braking arm 19 into a braking configuration, that is, for urging the braking arm 19 constantly towards the outer portion 7*b* of the fixed structure 7. Thus, as may now better be appreciated, when there is tension in the tensioned cable 5, the tensioned cable 5 overrides the biasing force of the biasing means 21 (e.g. springs 63) and pushes on the lever portion 20 of the swivel component 18, thereby urging the braking arm 19 away from the fixed structure 7 (i.e. side rail), whereas when there is a loss of tension in the cable 5, said cable 5 no longer pushes against the lever portion 20 and can no longer urge the braking arm 19 away from the fixed structure 7, and thus the braking arm 19 is in turn allowed and driven by the biasing means 21 towards the outer portion 7*b* of the fixed structure 7 (e.g. rail), and is designed in such a way that it engages the side rail in a frictional and/or deformable manner (by cutting, notching, etc., itself therein) so that once it is anchored into the side rail, the cable-operated door 3 is prevented or slowed down from falling.

More particularly, the present invention relates to substantial improvements of the above-mentioned brake device 1, which is mainly described in US patent application No. 2005/0183341 A1 made public on Aug. 25, 2005, and filed by the same Applicant as that of the present application, the content of said published patent application being incorporated herein by reference.

Indeed, as will be explained in greater detail hereinbelow, different and significant improvements have been made to the brake device 1 in order to overcome and remedy the above-discussed prior art problems.

For example, an important aspect of the present invention resides in that the brake device 1 is provided with an anti-theft mechanism 67 comprising a catcher assembly 69 and a protrusion 71 operatively projecting from the braking arm 19. The catcher assembly 69 is preferably operatively connectable to the fixed structure 7, such as the guide rail, or an adjacent portion of the fixed structure 7, as can be easily understood by a person skilled in the art. The protrusion 71 is preferably shaped, positioned and sized with respect to the catcher assembly 69 so as to be engaged with said catcher assembly 69 when the braking arm 19 is operated into the engaged configuration caused by a given loss of tension in the cable 5, thereby preventing the cable-operated door 3 from being displaced upwardly along the fixed structure 7 as a result of the catcher assembly 69 abutting against the protrusion 71 of the braking arm 19, as can be easily understood when referring to FIGS. 8-15, for example.

Preferably, and as better shown in FIGS. 8-12, the protrusion 71 of the braking arm 19 can be a component being removable mountable onto the braking arm 19 via at least one fastener. As illustrated in the above-mentioned figures, the protrusion 71 of the braking arm 19 is preferably a substantially V-shaped component having first and second flanges 73,75, the second flange 75 of the protrusion 71 being preferably removably mountable onto the braking arm 19 via at least one fastener 45, and preferably a pair of fasteners 45, as exemplified in FIGS. 8-12.

It is worth mentioning however that the protrusion 71 of the braking arm 19 according to the present invention may take on various other suitable embodiments, as can be easily understood by a person skilled in the art. For example, and as exemplified in FIGS. 13-16, the protrusion 71 of the braking arm 19 could be made integral to the braking arm 19, that is, could be made of a same and single component, made of a unique material, via a suitable manufacturing process, such as molding, casting, and the like, as can be easily understood by a person skilled in the art.

Figure 12:
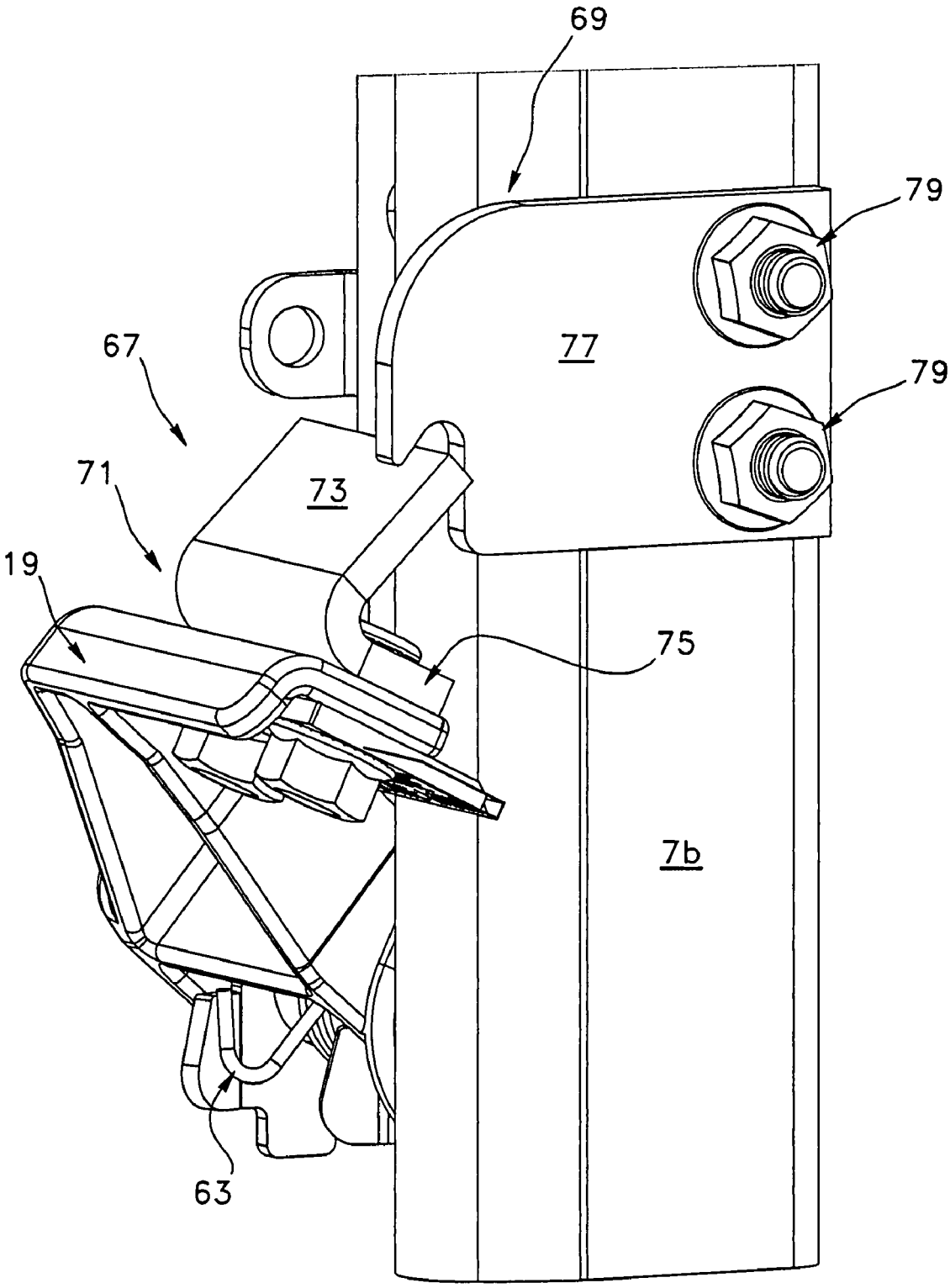
FIG. 12 is an enlarged view of a portion of what is shown in FIG. 11.
Figure 13:
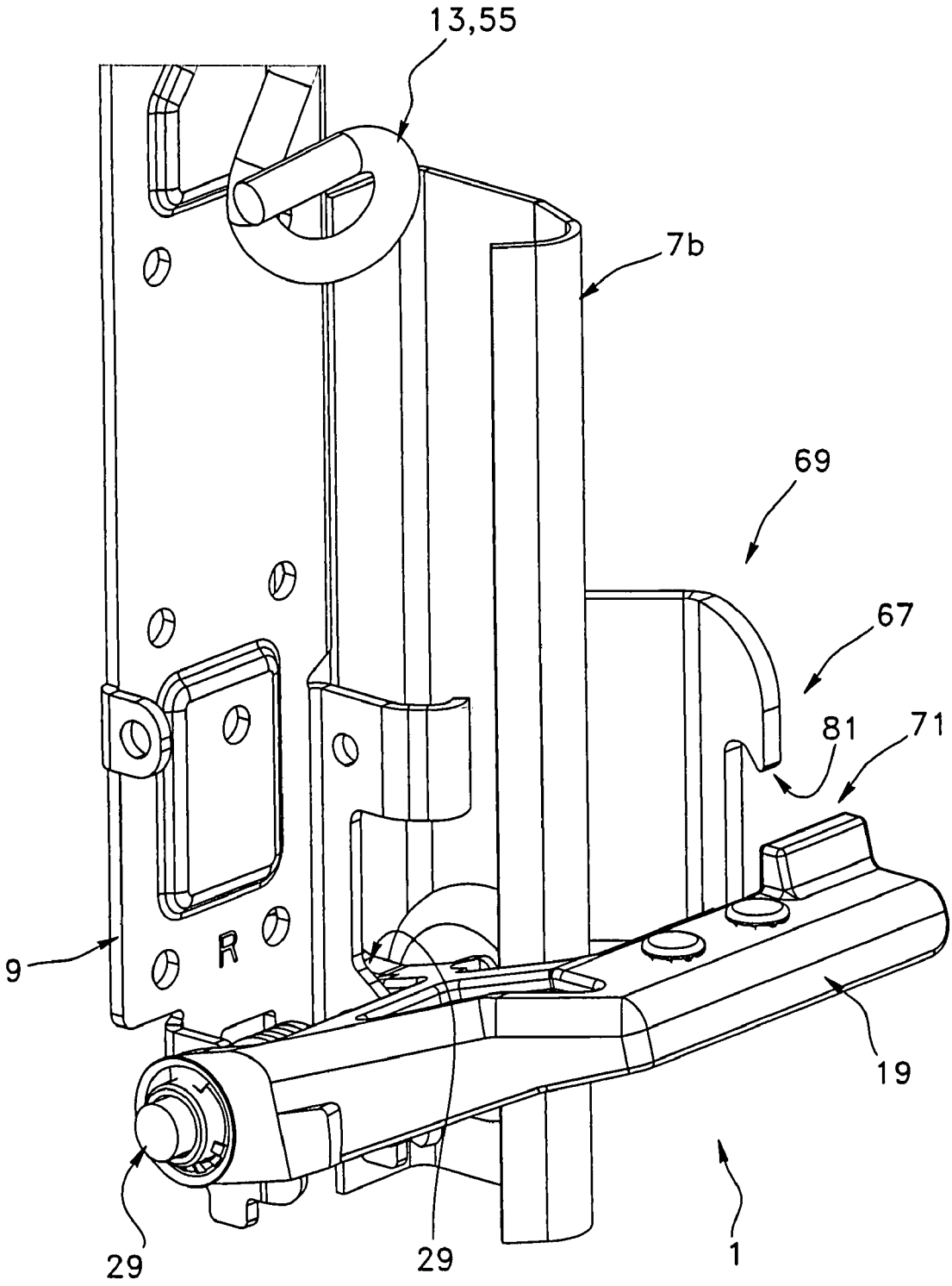
FIG. 13 is a partial perspective view of a brake device with integrated anti-theft mechanism cooperating with a fixed structure according to yet another preferred embodiment of the present invention, the braking arm and corresponding protrusion being shown in a retracted configuration.
Figure 14:
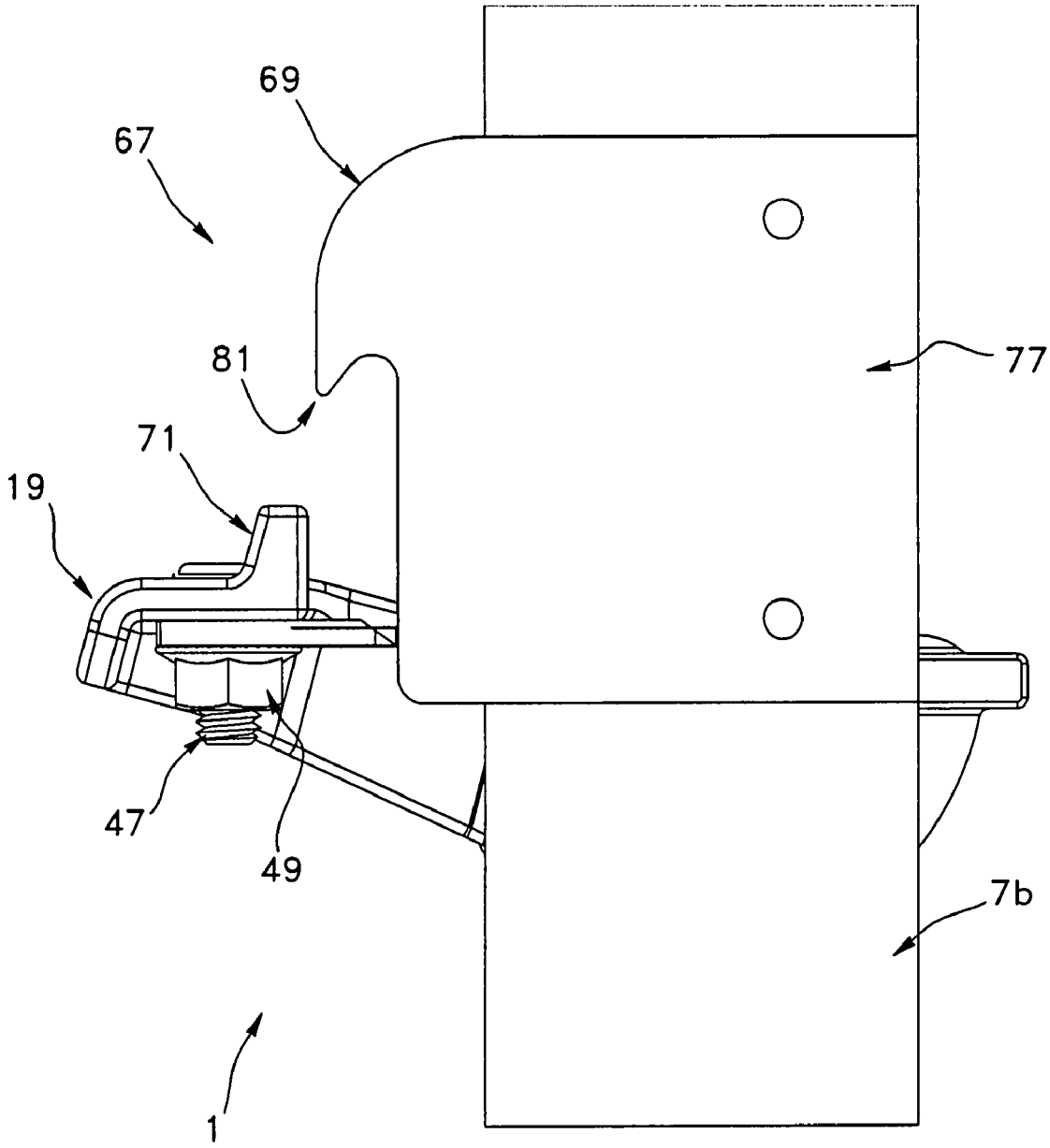
FIG. 14 is a partial side view of what is shown in FIG. 13.
Figure 15:
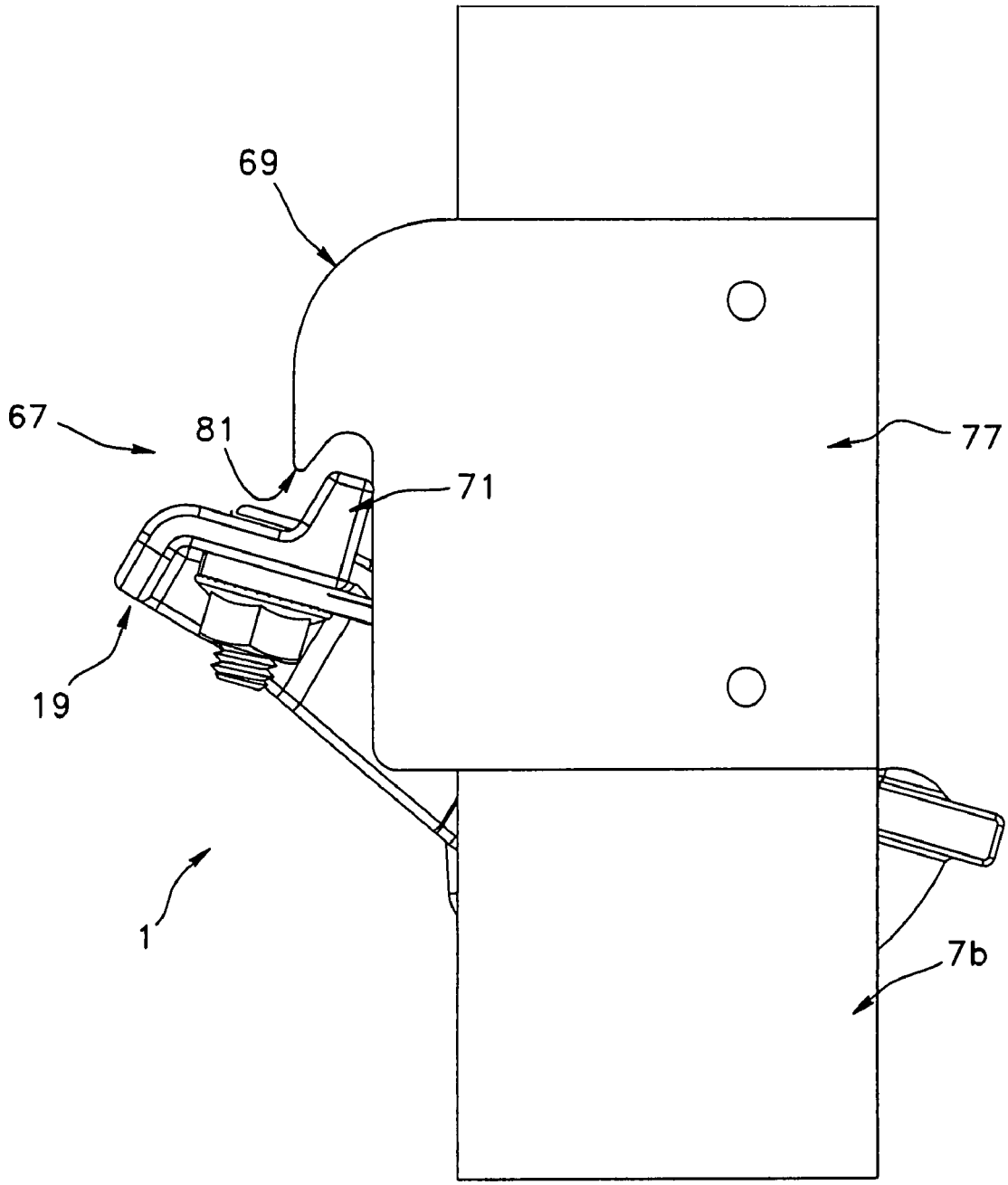
FIG. 15 is another view of what is shown in FIG. 14, the braking arm and corresponding protrusion of the brake device with integrated anti-theft mechanism being now shown in a hooked configuration with the protrusion being engaged into the hooking portion of the catcher assembly.

Referring now to the catcher assembly 69 according to the present invention, it preferably comprises a component 77 being removably mountable onto the outer portion 7*b* of the fixed structure 7 via at least one fastener 79, as exemplified in FIG. 12, for example. It is worth mentioning however that according to the present invention, the component 77 may be suitably mounted onto other appropriate locations, such as an adjacent wall of the fixed structure 7, for example, as can be easily understood by a person skilled in the art. Preferably, and as also shown, the catcher assembly 69 comprises a hooking portion 81 for engaging a corresponding projecting portion of the protrusion 71 of the braking arm 19. However, it is worth mentioning that the catcher assembly 69 according to the present invention may take on other various suitable embodiments in order to properly and adequately carry out its corresponding functions, as can be easily understood by a person skilled in the art.

For example, the catcher assembly 69 could comprise a catcher lock 83 being operatively mounted onto the fixed structure 7 in a rocking manner, the catcher lock 83 being configured so as to be rocked between a released configuration where a hooking portion 81 of the catcher lock 83 is positioned away from the protrusion 71 of the braking arm 19, thereby enabling the cable-operated door 3 to be displaced along the fixed structure 7, and a hooked configuration where the hooking portion 81 of the catcher lock 83 is engaged against the protrusion 71 of the braking arm 19, thereby preventing the cable-operated door 3 from being displaced upwardly along the fixed structure 7 as a result of the hooking portion 81 of the catcher lock 83 abutting against the protrusion 71 of the braking arm 19, as can be easily understood by a person skilled in the art in view of the accompanying drawings.

Indeed, for example, and when referring to FIGS. 30-40, the catcher lock 83 can be operatively mounted onto the fixed structure 7 by means of a housing 85 being removably connectable to said fixed structure 7, the catcher lock 83 being pivotally mounted onto the housing by means of a lock pivot 87, and the catcher lock 83 being spring-loaded by means of a spring 89 (e.g. an extension spring, a compression spring, a torsional spring, a lamella, or any other suitable biasing device, as apparent to a person skilled in the art) operatively connected between the catcher lock 83 and the housing 85.

Preferably also, and as shown in the above-mentioned figures, the catcher assembly 69 further comprises a pedal 91 being pivotally mounted onto the housing 85 by means of a pedal pivot 93, the pedal 91 being provided with an actuating end 95 shaped, positioned and sized for cooperating with and actuating a corresponding receiving portion 97 of the catcher lock 83.

Preferably also, and as shown, the pedal 91 is spring-loaded by means of a spring 99 (e.g. an extension spring, a compression spring, a torsional spring, a lamella, or any other suitable biasing device, as apparent to a person skilled in the art) having one end operatively connected to the pedal 91 and another end operatively connected to the housing 85.

Figure 32:
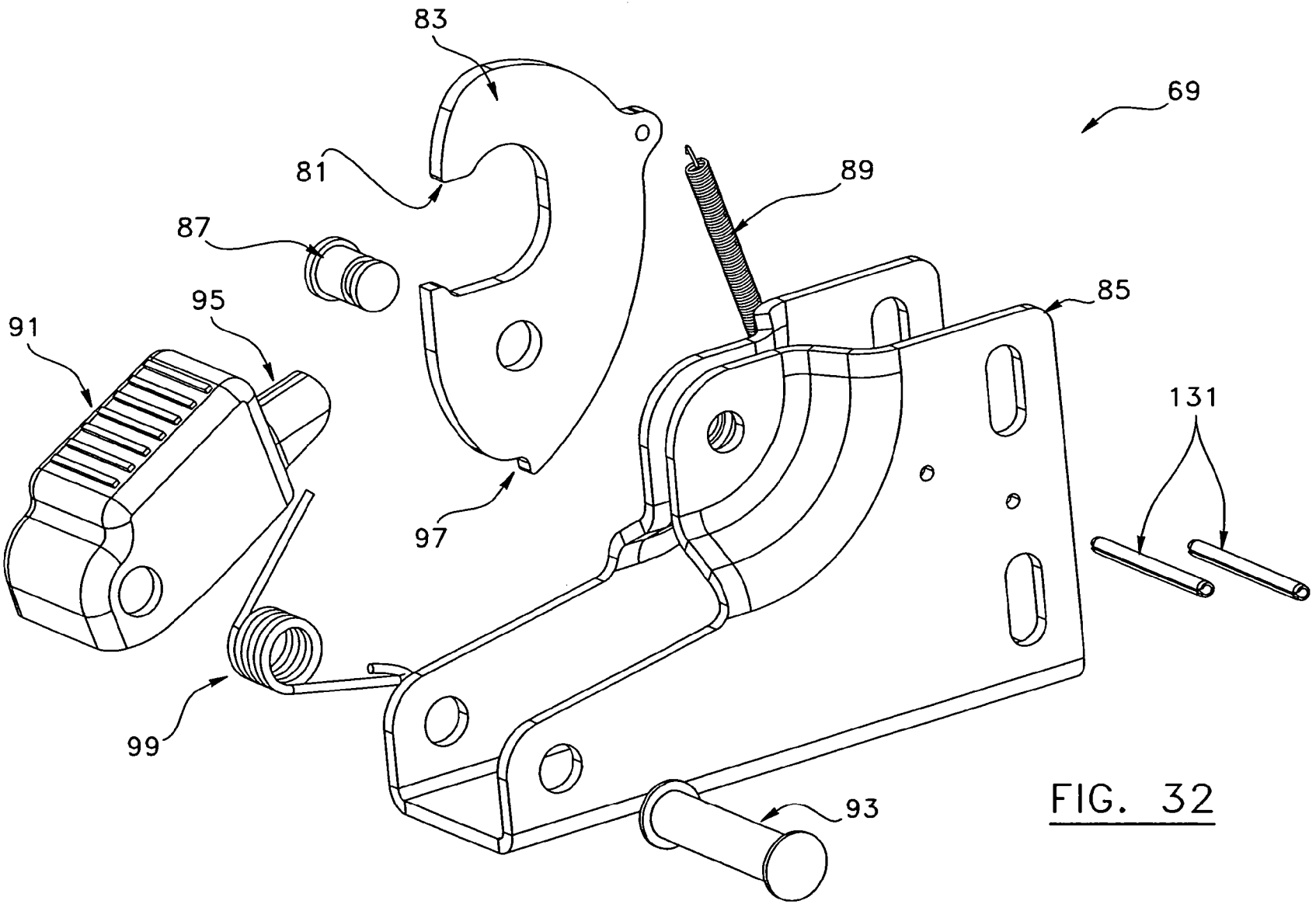
FIG. 32 is an exploded view of the components of the catcher assembly shown in FIG. 30.

Thus, as can be easily understood by a person skilled in the art, the working principle of the catcher assembly 69 such as the one exemplified in FIGS. 30-40 is fairly simple. Indeed, the pedal 91 is preferably spring-loaded so as to be biased upwardly, and the catcher lock 83 is also preferably spring-loaded, as well as positioned, shaped and sized, so as to open and allow the passage of the brake device 1. When the door assembly 3 is lowered, the braking arm 19 (or any other suitable part of component 18) pushes against the catcher lock 83 which in turns causes it to be locked, by virtue of the components cooperating therewith, as illustrated in FIG. 32. Once locked, the pedal 91 is raised, by virtue of its cooperation with the catcher lock 83, namely by means of its actuating end 95, and blocks the catcher lock 83 in place so that the latter may not be opened. Thus, the door assembly 3 cannot be opened anymore unless the pedal 91 is activated by a user located inside the door assembly 3.

When one steps on the pedal 91, the catcher lock 83 is thus free in rotation, which enables thus to allow the swivel component 18 (i.e. braking arm 19, etc.) of the system to pass and which thus enables the door assembly 3 to be raised.

Thus, as may now be better appreciated in view of the above, different other suitable catcher assemblies 69 may be used with the brake device 1 with integrated anti-theft mechanism 67 according to the present invention, depending on the particular functions for which the catcher assemblies 69 are intended for, and the different types of door assemblies 3 to be used therewith, as apparent to a person skilled in the art.

Figure 17:
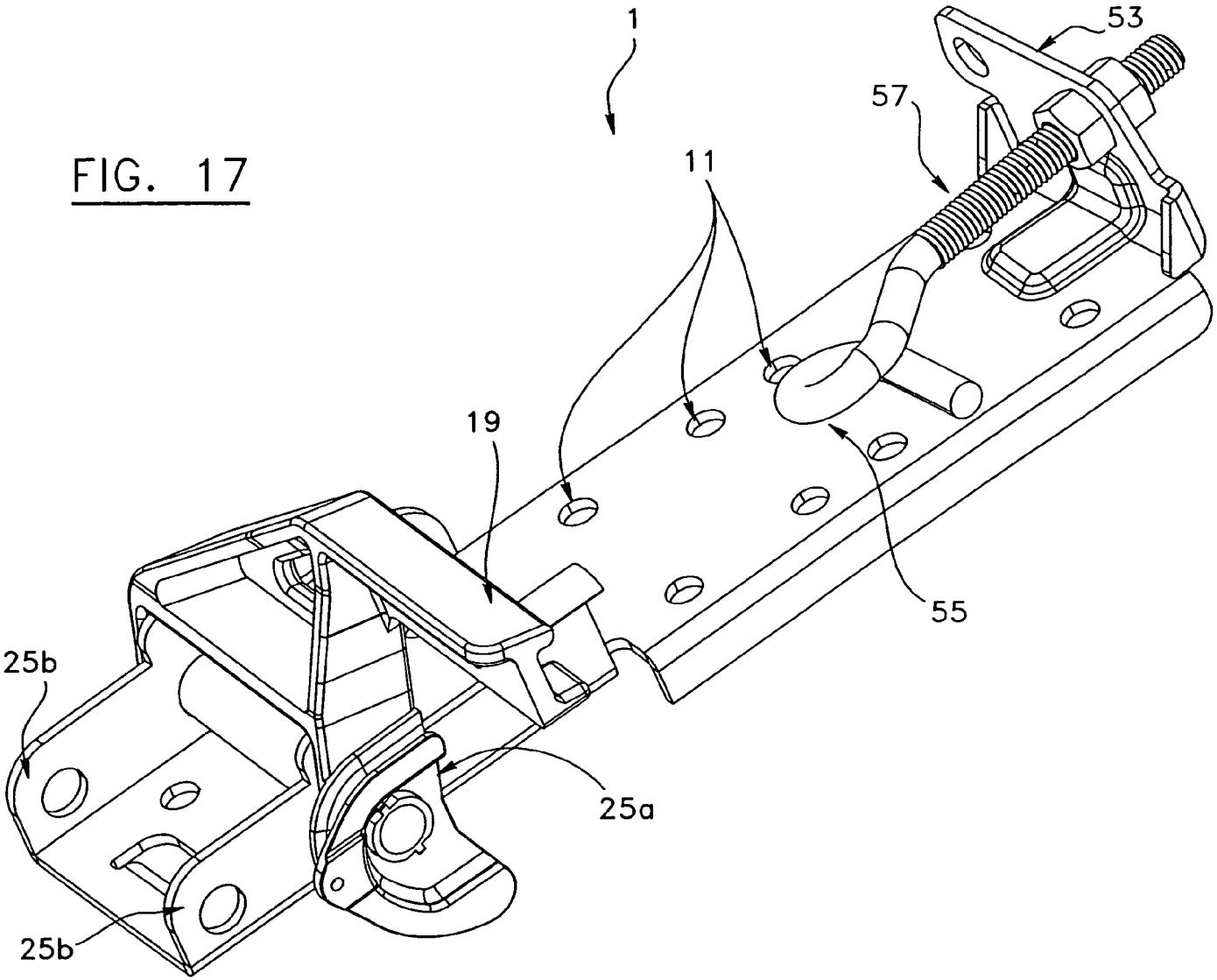
FIG. 17 is a perspective view of a brake device with integrated anti-theft mechanism according to yet another preferred embodiment of the present invention, this particular embodiment better illustrating the additional support arms being provided in complement to the main support arms.
Figure 18:
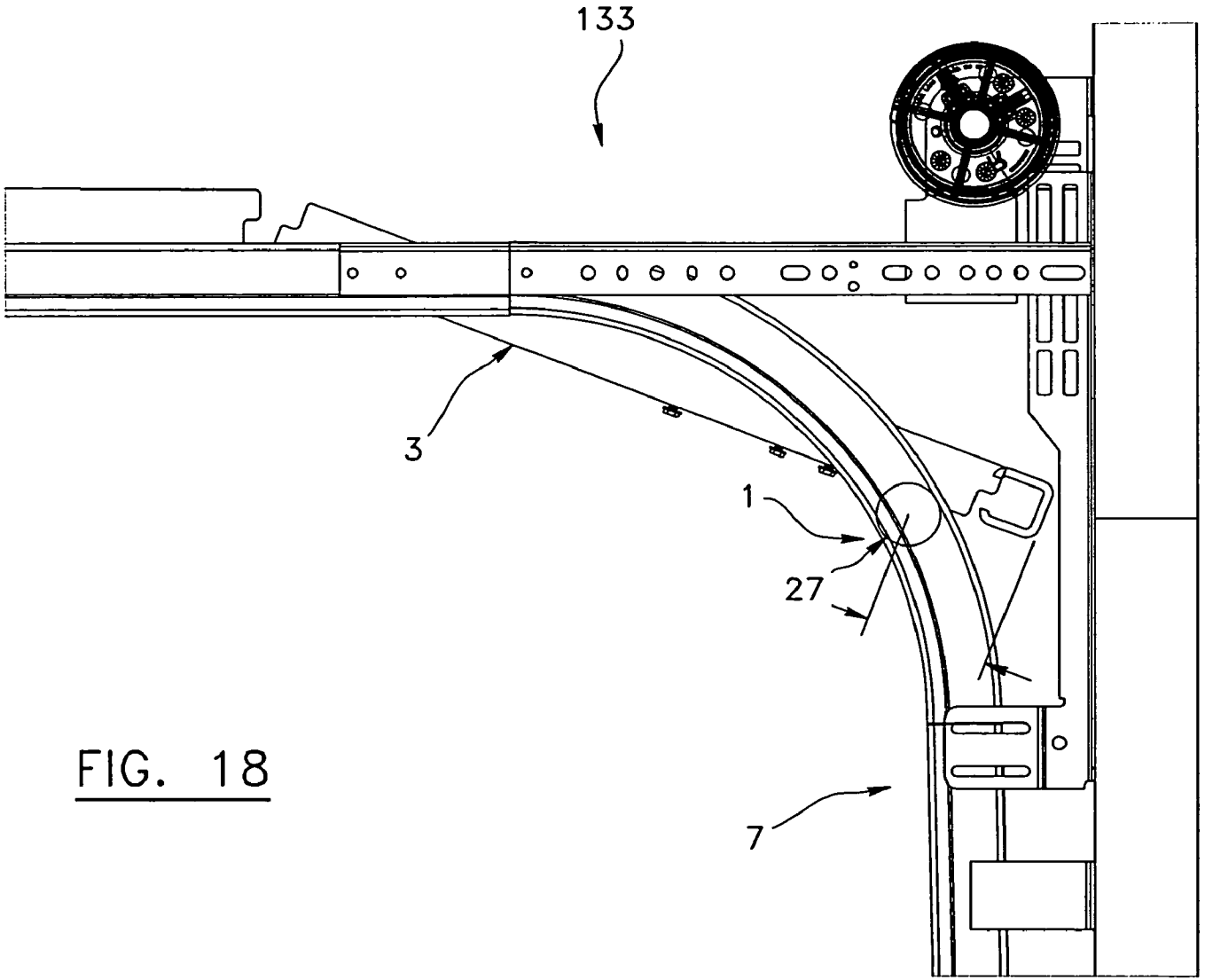
FIG. 18 is a partial side view of a door assembly provided with a brake device with integrated anti-theft mechanism according to a preferred embodiment of the present invention.

Referring now to FIG. 17, and according to a preferred embodiment of the present invention, the support bracket 9 comprises a pair of main support arms 25*a* so that the shaft 29 of a corresponding roller 27 of the guiding assembly 15 may be rotably mounted about said main support arms 25*a*. Preferably also, the support bracket 9 comprises a pair of additional support arms 25*b* positioned below the main support arms 25*a*, so that the shaft 29 of the roller 27 of the guiding assembly 15 may be selectively mounted about said additional support arms 25*b* for selectively lowering positioning of the roller 27 with respect to the support bracket 9, for certain applications, as will be explained in greater detail hereinbelow.

Figure 19:
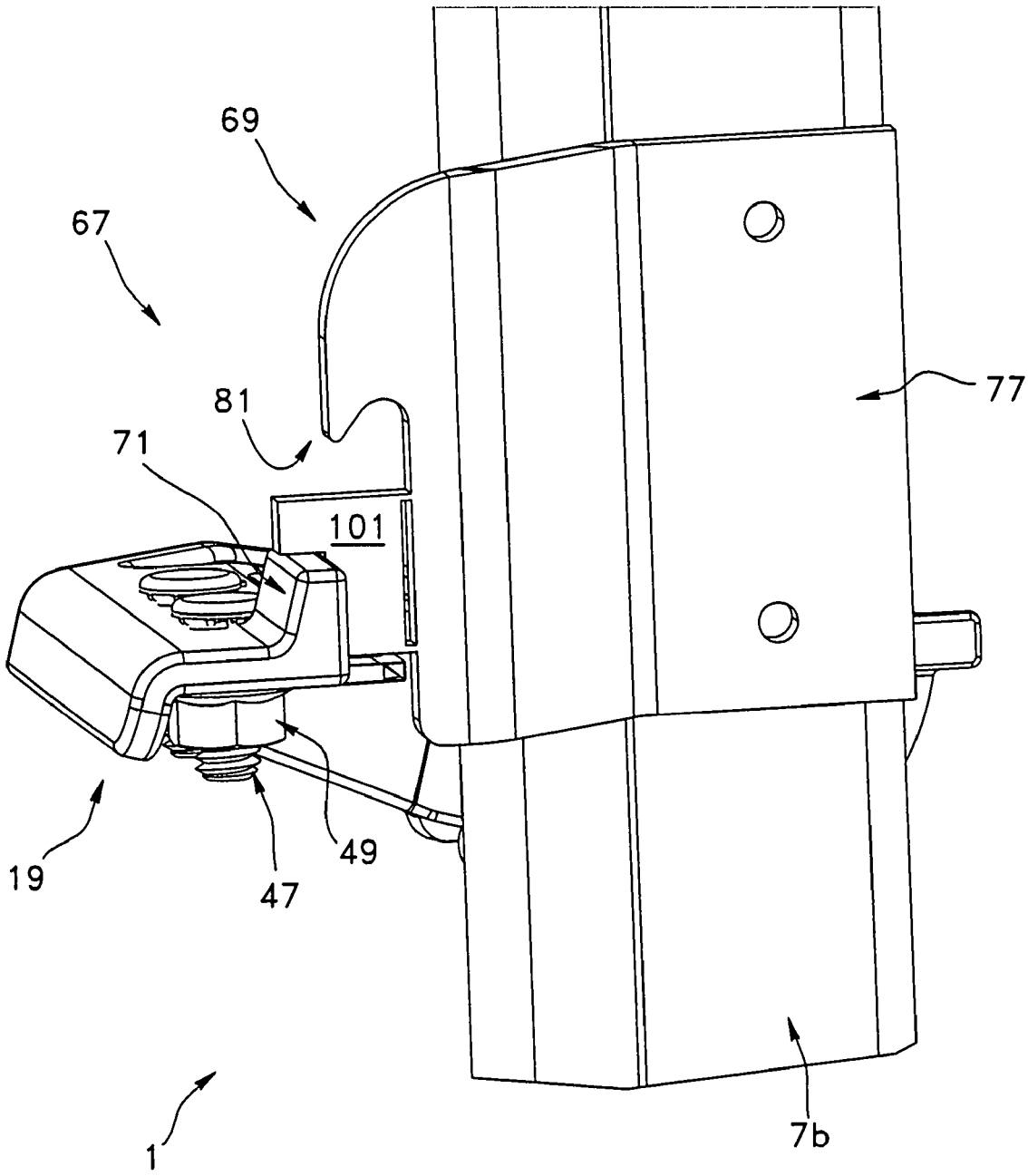
FIG. 19 is a partial perspective view of a brake device with integrated anti-theft mechanism cooperating with a catcher assembly provided with a breakable section according to yet another preferred embodiment of the present invention.
Figure 20:
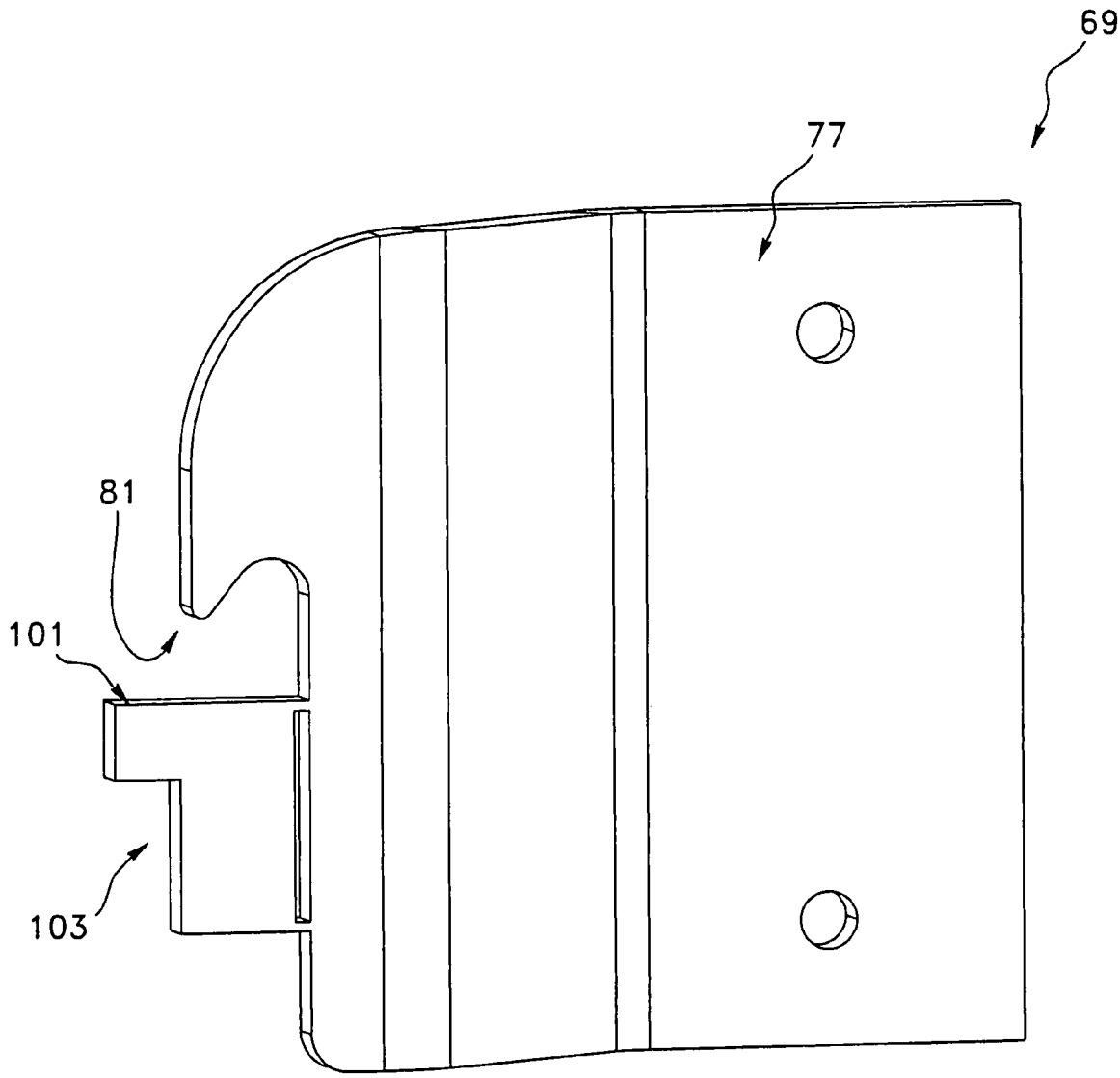
FIG. 20 is a side view of the catcher assembly and corresponding breakable section shown in FIG. 19.
Figure 21:
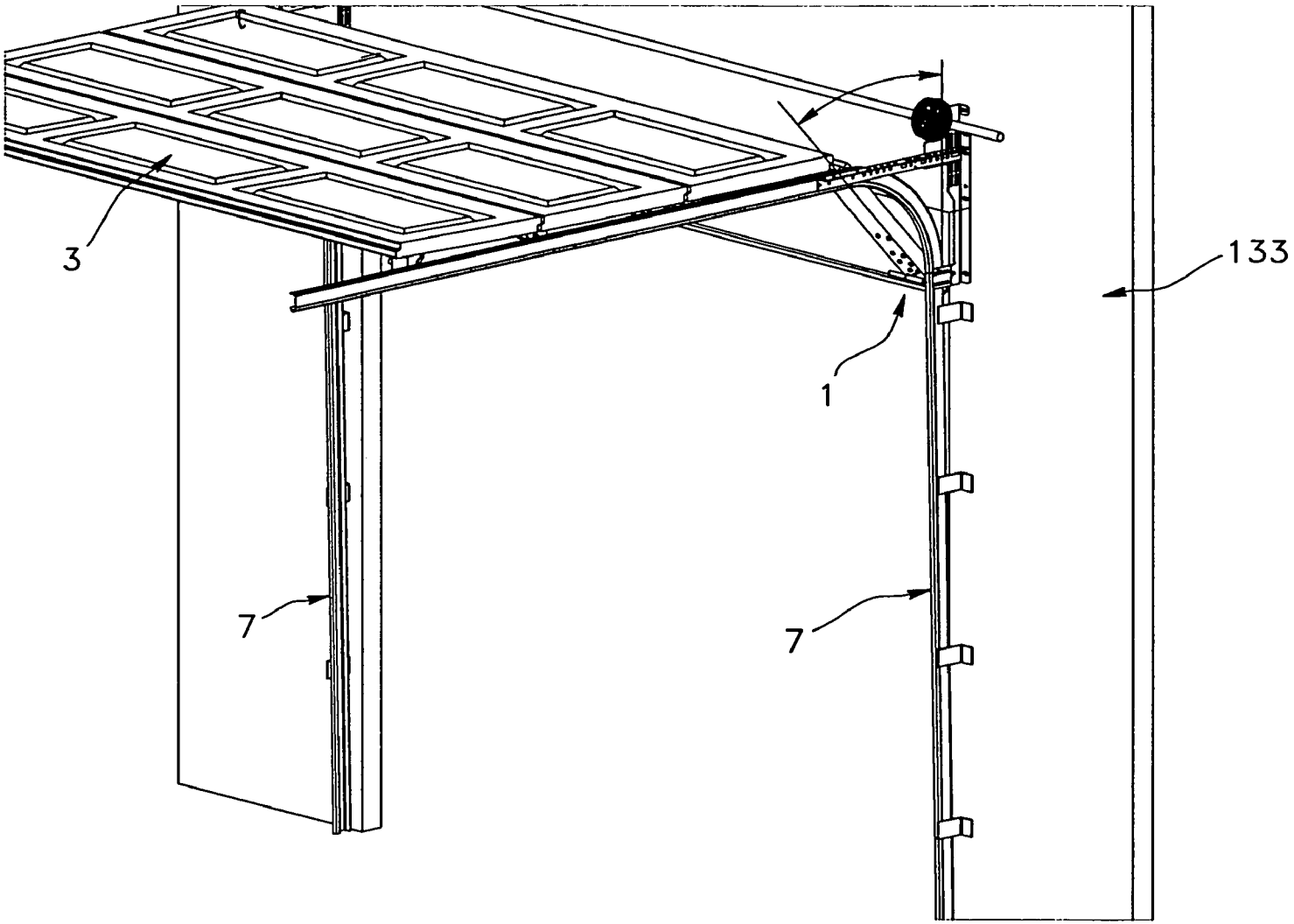
FIG. 21 is a partial perspective view of a door assembly provided with a brake device with integrated anti-theft mechanism according to another preferred embodiment of the present invention.
Figure 22:
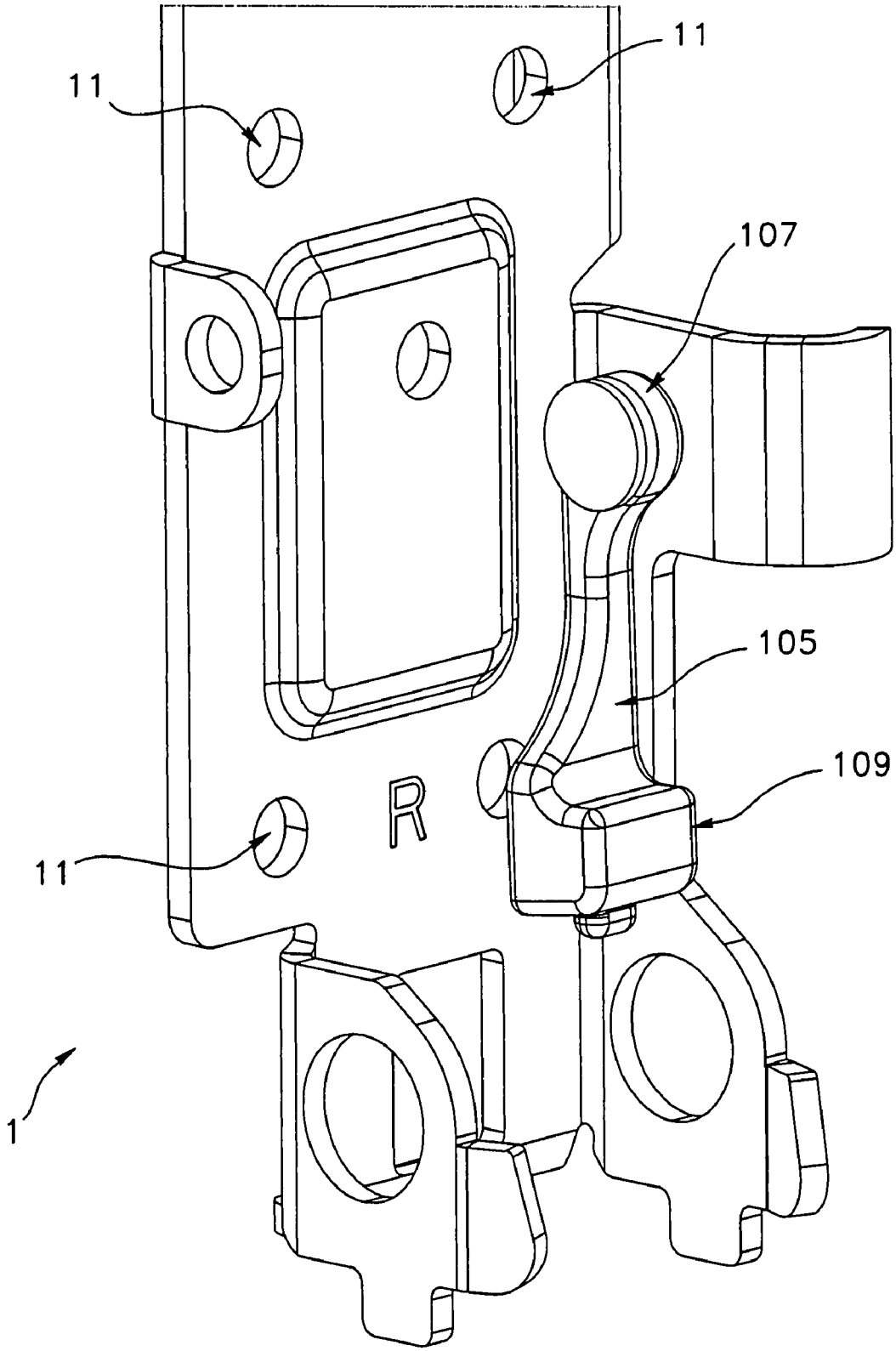
FIG. 22 is a partial perspective view of a support bracket of a brake device with integrated anti-theft mechanism provided with a stopper arm according to a preferred embodiment of the present invention.

According to another preferred embodiment of the present invention, and as exemplified in FIGS. 19 and 20, the catcher assembly 69 may comprise a component 77 having a breakable section 101 projecting outwardly from the catcher assembly 69 for cooperating with the protrusion 71 of the braking arm 19, the breakable section 101 defining a recess 103 being complementary in shape to said protrusion 71 for facilitating positioning of the catcher assembly 69 with respect to the protrusion 71 of the braking arm 19, the breakable section 101 being removable from the catcher assembly 69 upon installation.

Figure 23:
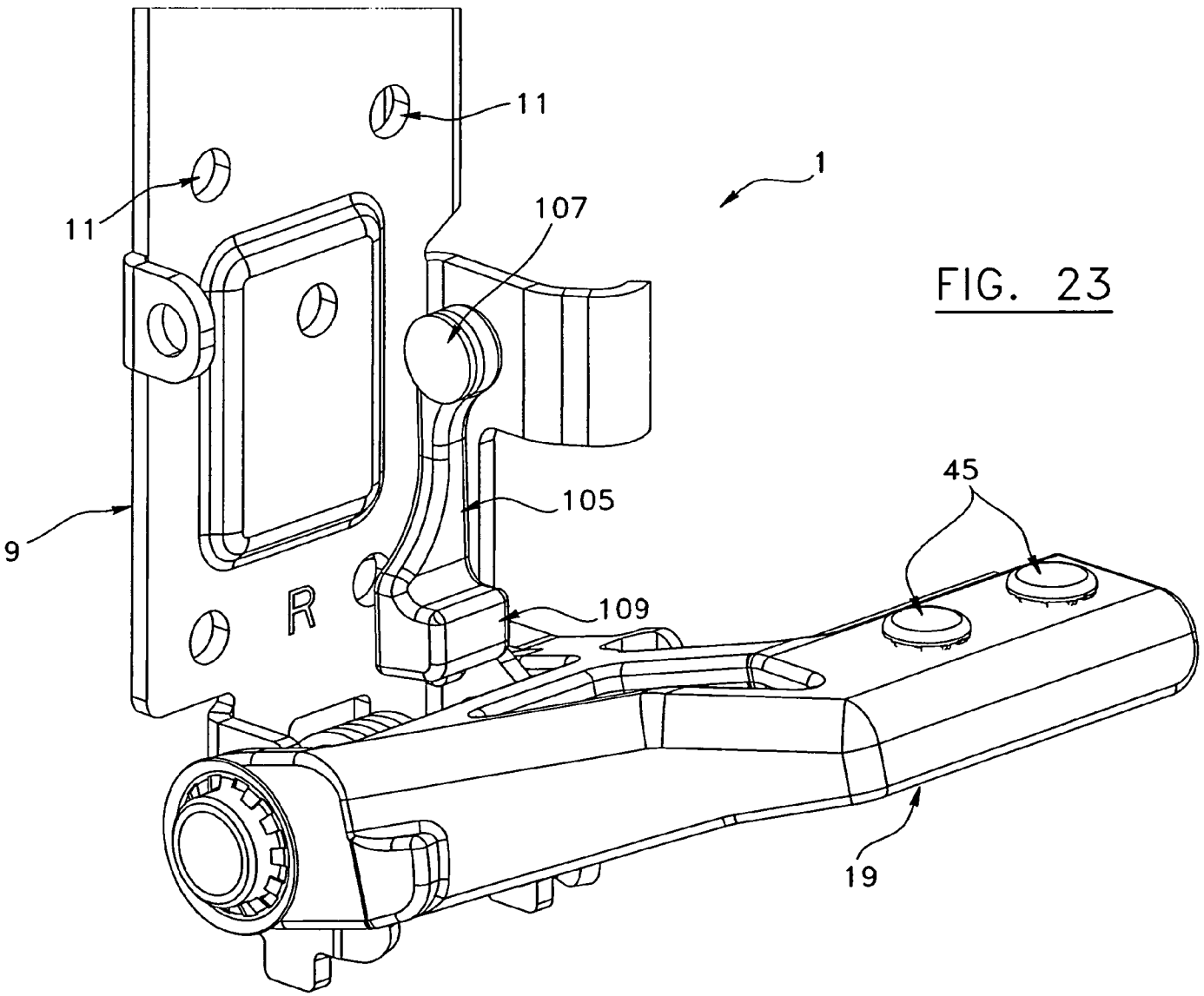
FIG. 23 is another perspective view of what is shown in FIG. 22, the support bracket being now shown provided with a corresponding braking assembly.
Figure 24:
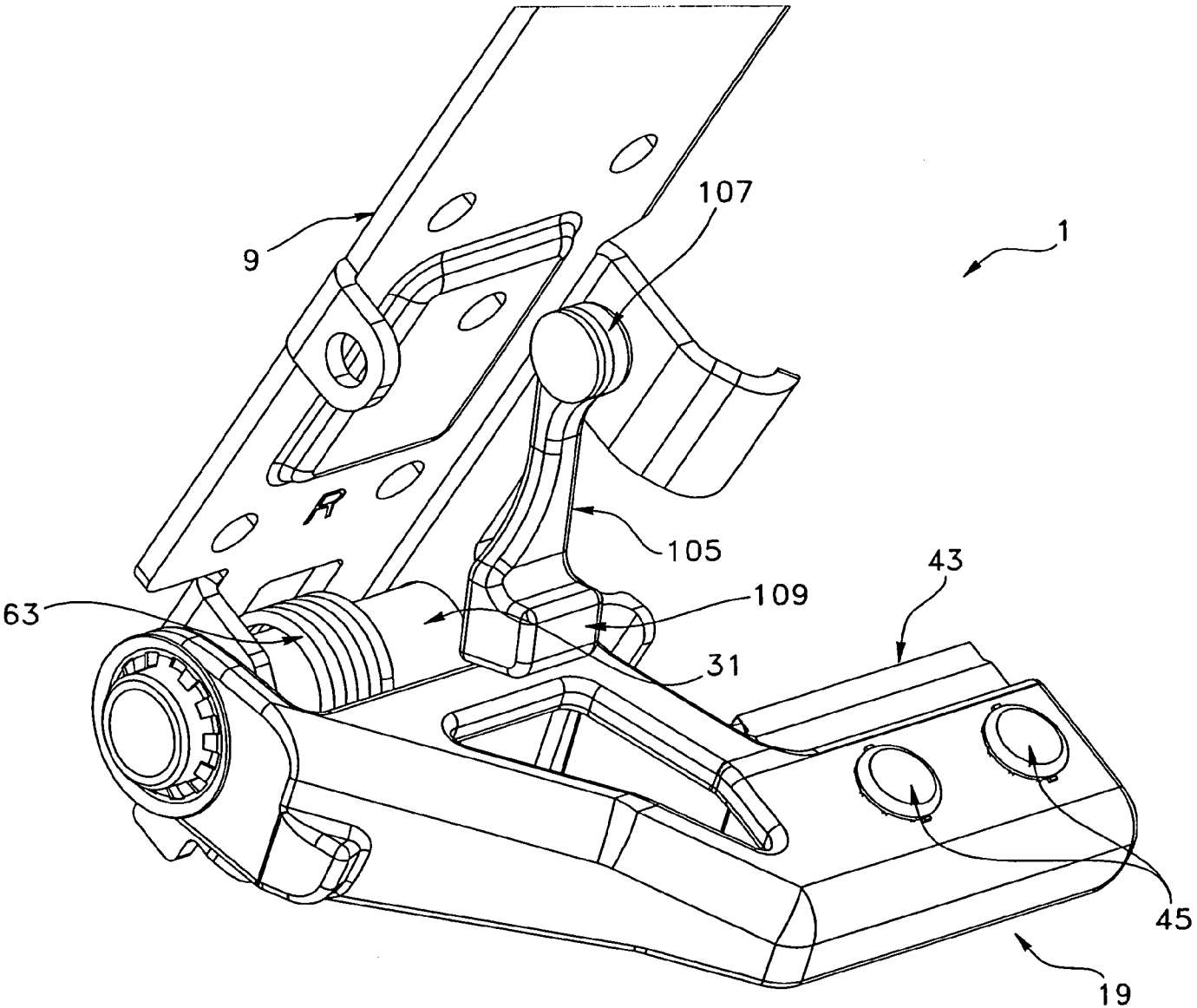
FIG. 24 is another perspective view of what is shown in FIG. 23, the support bracket being now shown at an angle with respect to a vertical plane so as to better illustrate cooperation of the stopper arm with the braking arm.
Figure 25:
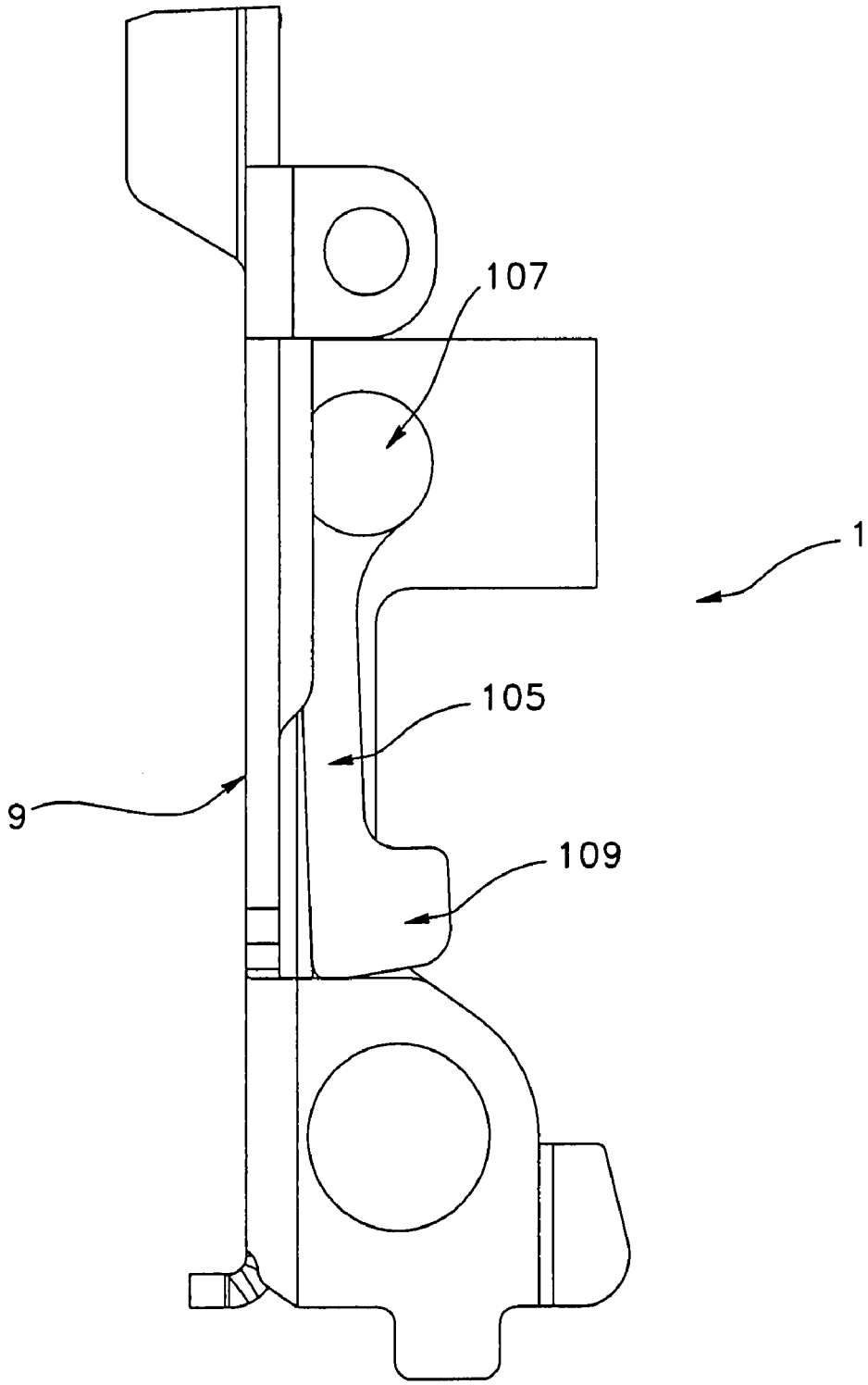
FIG. 25 is a partial side view of what is shown in FIG. 22.
Figure 26:
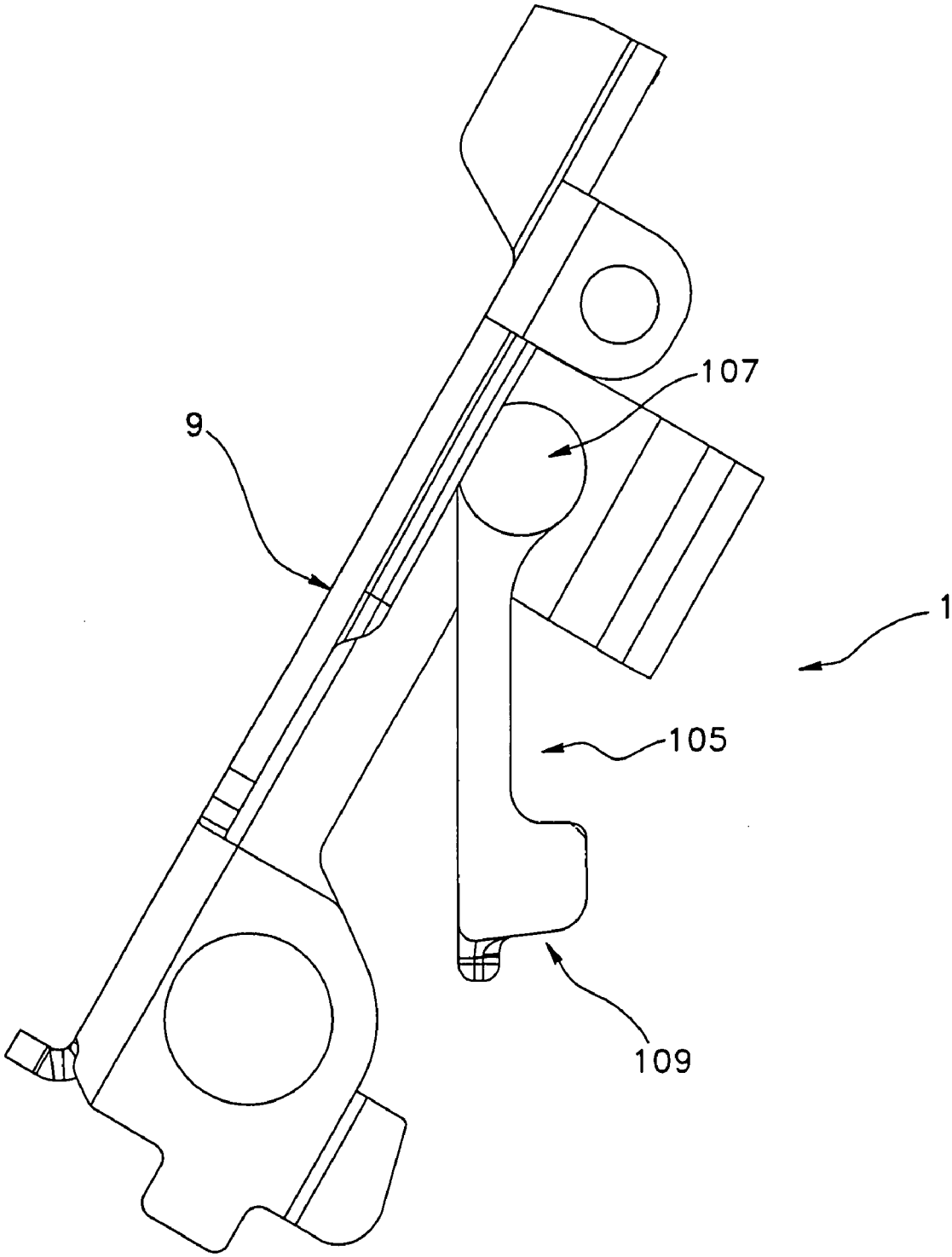
FIG. 26 is another side view of what is shown in FIG. 25, the support bracket being now shown at an angle with respect to a vertical plane.
Figure 27:
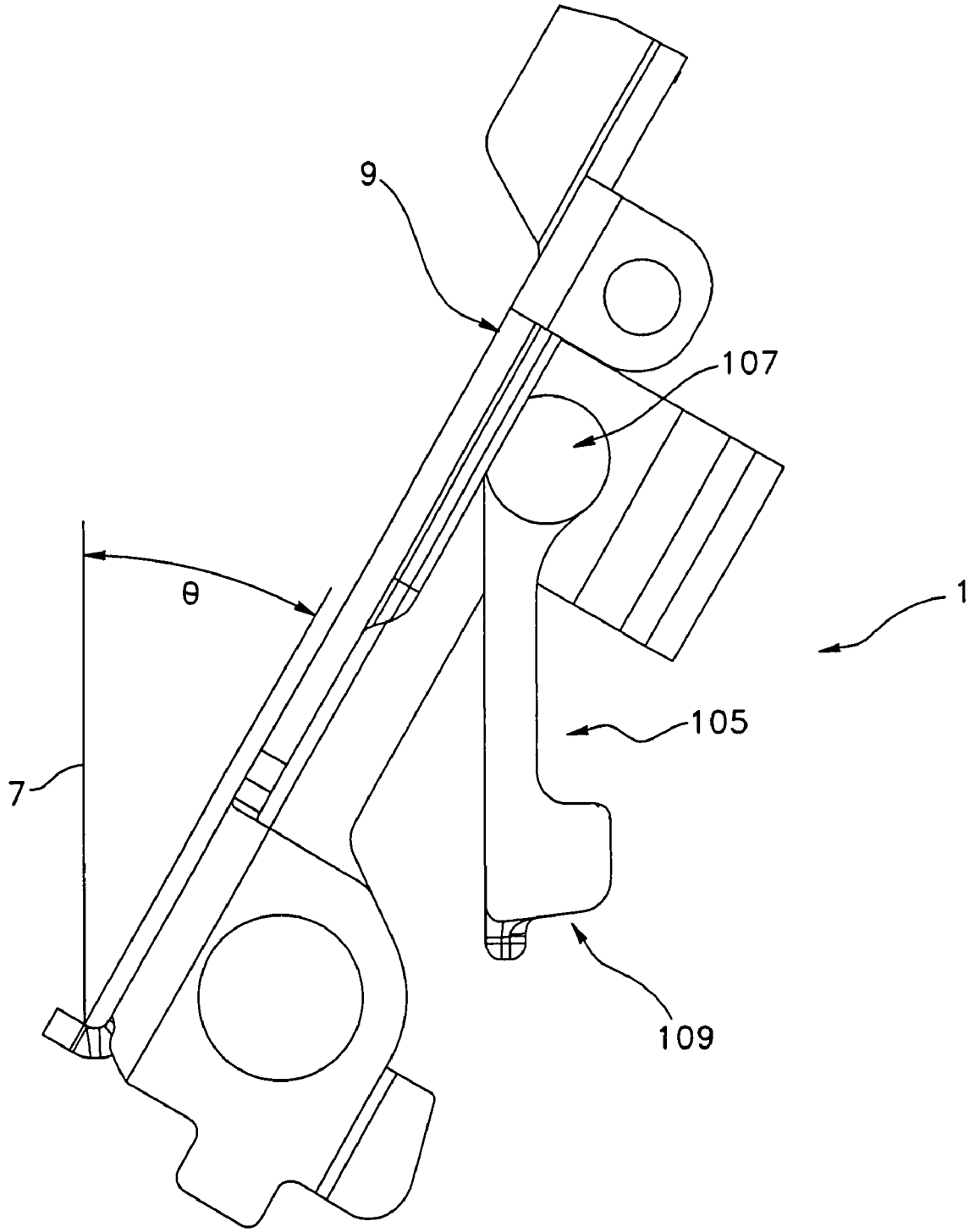
FIG. 27 is another side view of what is shown in FIG. 26, the support bracket being now shown at an angle with respect to a schematic fixed structure.

According to yet another preferred embodiment of the present invention, and as better illustrated in FIGS. 22-27, the brake device 1 comprises a stopper arm 105 pivotally mounted and movable about the support bracket 9, the stopper arm 105 having a first end 107 pivotally connected to the support bracket 9 and a second end 109 for cooperating with the braking arm 19, the stopper arm 105 being positioned, shaped and sized so that its second end 107 abuts against the braking arm 19 upon an orientation of the support bracket 9 at a given angle θ with respect to the fixed structure 7 so as to prevent rotation of the swivel component 18 and thus prevent the braking arm 19 from being operated into the engaged configuration, as can be easily understood by a person skilled in the art when referring to FIGS. 23 and 24, for example.

Figure 28:
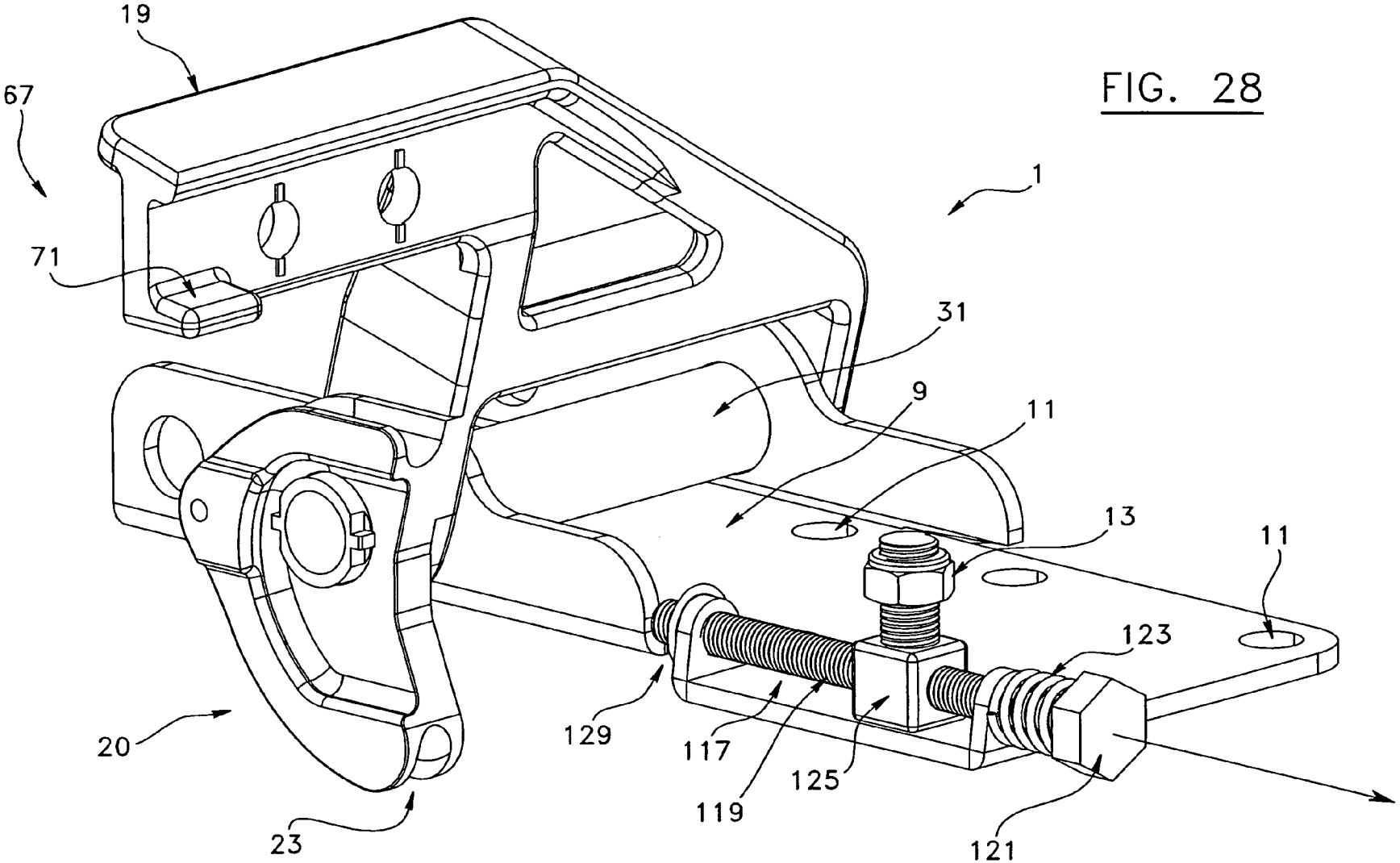
FIG. 28 is a perspective view of a brake device with integrated anti-theft mechanism provided with an adjustable connection point according to a preferred embodiment of the present invention.
Figure 29:
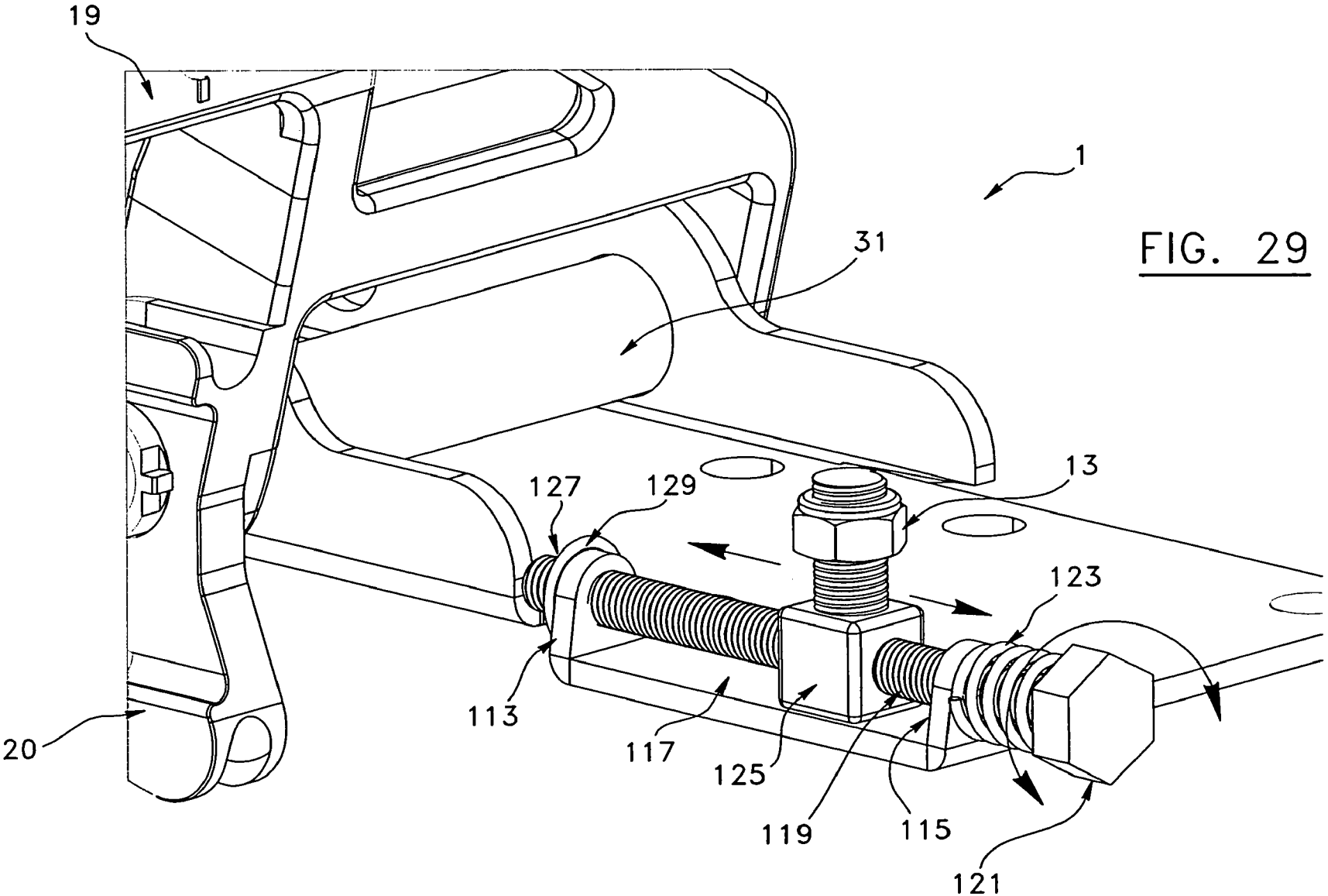
FIG. 29 is an enlarged view of a portion of what is shown in FIG. 28.
Figure 30:
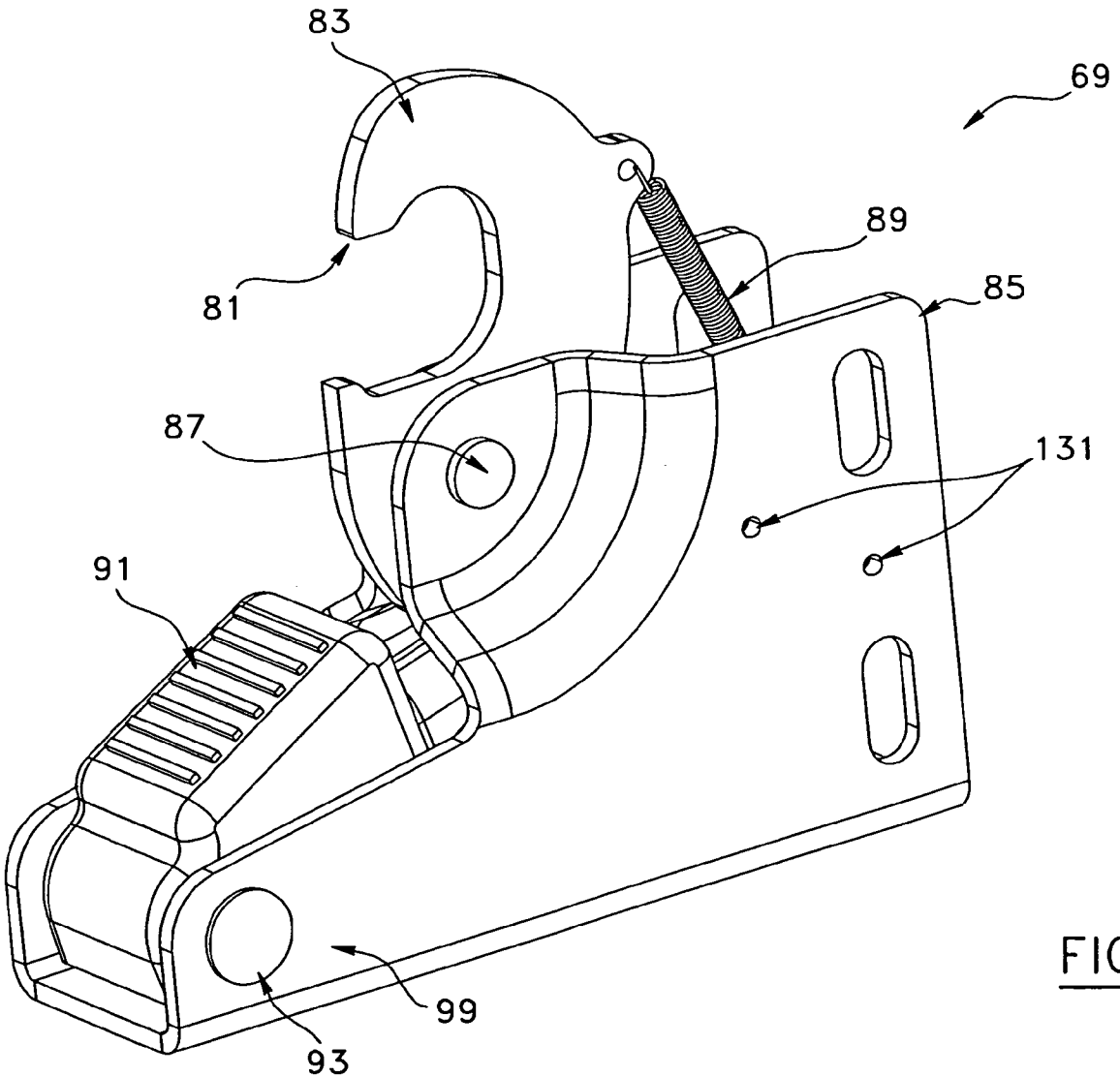
FIG. 30 is a perspective view of a catcher assembly according to yet another preferred embodiment of the present invention, the catcher assembly being shown in a first configuration.
Figure 31:
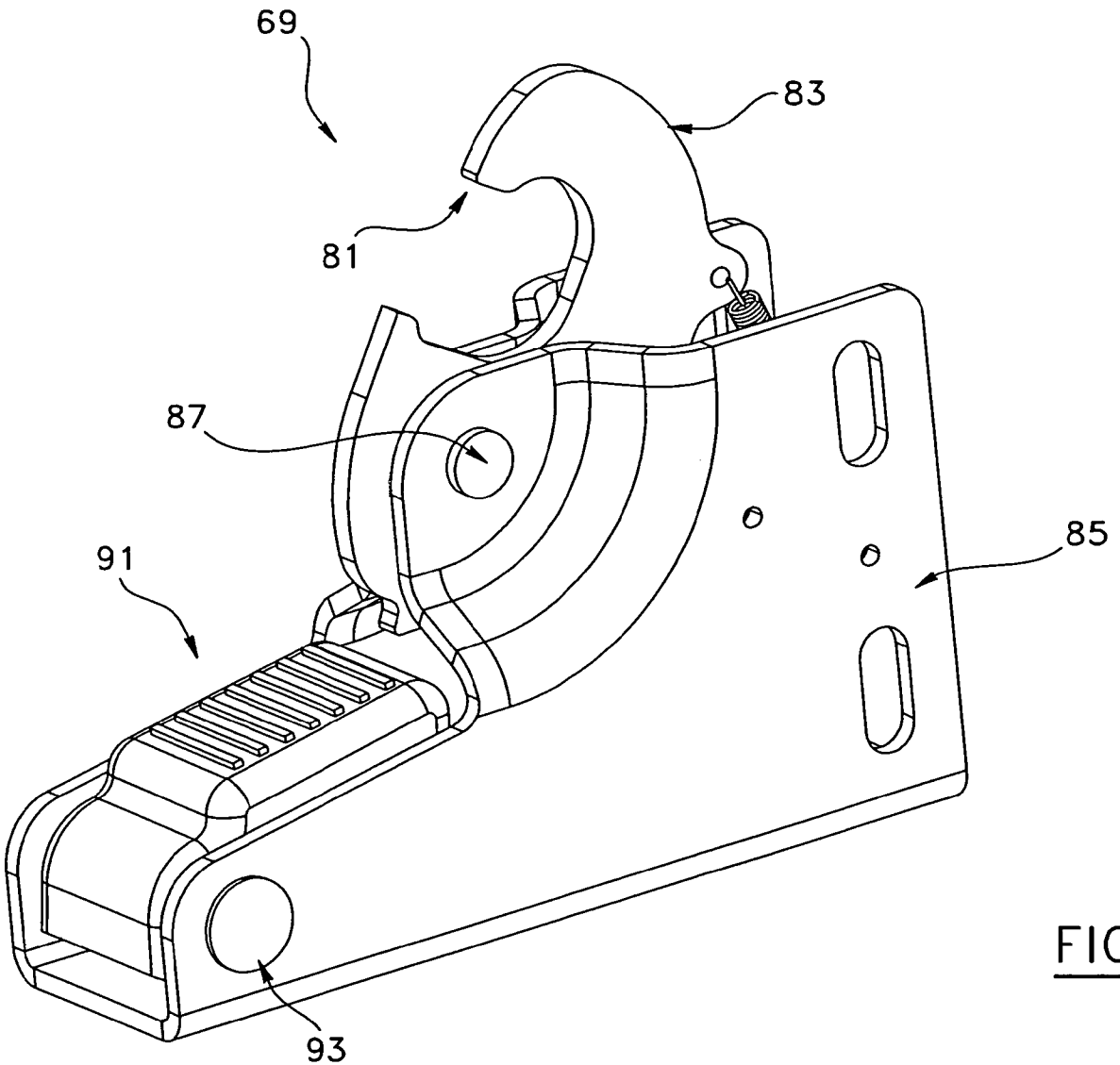
FIG. 31 is another perspective view of what is shown in FIG. 30, the catcher assembly being shown in another configuration.

Referring now to FIGS. 28 and 29, and according to another preferred embodiment of the present invention, the connection point 13 is operatively connected to a spring 123 so as to provide the brake device 1 with a spring-loaded connection point 13, as can be easily understood by a person skilled in the art. Preferably also, and as shown, the support bracket 9 comprises first and second supports 113,115 for receiving an adjustment bolt 117 having a shaft 119 provided with a corresponding head 121, the shaft extending through the first and second supports 113,115, and the head 121 of the adjustment bolt 117 being biased away from the second support 115 via a spring 123 extending between said head 121 of the adjustment bolt 117 and the second support 115, the connection point 13 being mounted onto a block 125 threadedly engaged with the shaft 119 of the adjustment bolt 117 so as to be displaced therealong via a rotation of said adjustment bolt 117, as can be easily understood by a person skilled in the art.

Preferably also, and as better shown in FIG. 29, a tip 127 of the shaft 119 is provided with a clip 129 positioned adjacent and outwardly from the first support 113 of the support bracket 9 for preventing the tip 127 of the shaft 119 from being removed from said first support 113.

The braking device 1 according to the present invention also preferably comprises a guiding channel 23 defined within the lever portion of the swivel component for guiding the tensioned cable 5 about the braking assembly 17 and onto the connection point 13 of the support bracket 9, as better represented in FIG. 28.

Preferably also, and as shown in the accompanying drawings, the braking arm 19 has a hinging portion 33 pivotably mounted about the sleeve 31. The hinging portion 33 preferably comprises a pair of hinging flanges 39 each having a corresponding orifice 41 for the sleeve 31 to pass therethrough.

Preferably also, the guiding channel 23 is operatively connected to the hinging portion 33 of the braking arm 19, and is preferably made integral to said hinging portion 33. It is worth mentioning though that the braking arm 19, lever portion 20, guiding channel 23, and hinging portion 33 according to the present invention may take on various other suitable embodiments. Indeed, the may consist of a single component, and may be made integral to each other (i.e. same component made out of the same material), as shown in the accompanying drawings, or may be defined by various separate components connectable to each other by suitable means, as apparent to a person skilled in the art.

Figure 16:
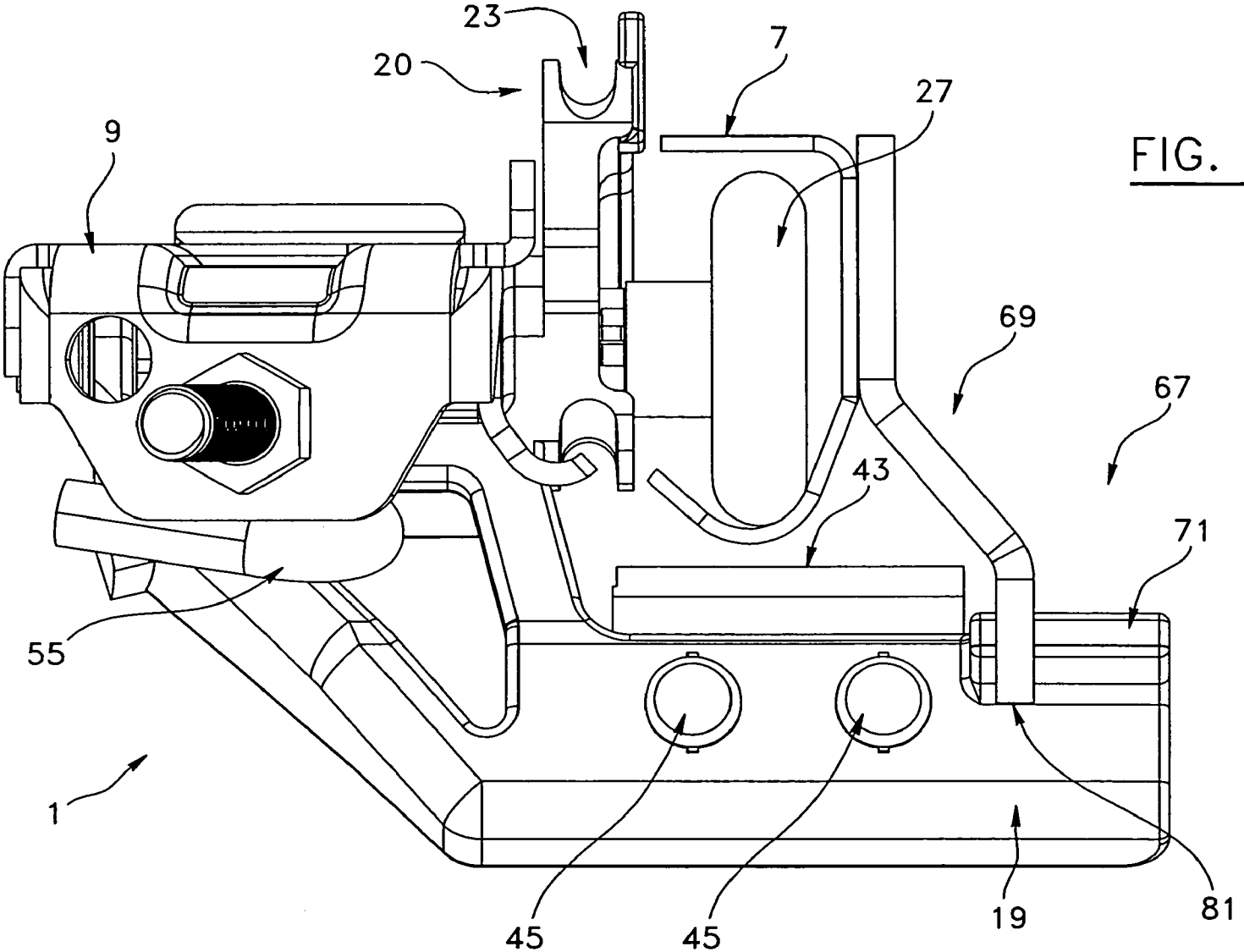
FIG. 16 is a bottom plan view of what is shown in FIG. 15.

Preferably, and as better shown in FIG. 16, the braking arm 19 is provided with a knife 43 having an edge extending from the braking arm 19 for engaging with the outer portion 7*b* of the fixed structure 7 when in the braking configuration. The knife 43 is preferably removably mounted onto the braking arm 19 with at least one fastener 45. Said at least one fastener 45 preferably comprises a pair of fasteners 45 each comprising a bolt 47 and a corresponding nut 49, each bolt 47 being insertable through a corresponding hole 51 provided along the braking arm 19. It is worth mentioning that other suitable means may be used for properly securing the knife 43 onto the braking arm 19, as apparent to a person skilled in the art. For example, a given knife 43 could be made integral to the braking arm 19, that is, made of one single component and made out of the same material, in which case said knife 43 would also act as the braking arm 19 itself, as also apparent to a person skilled in the art.

Preferably, and as better shown in FIG. 17, the support bracket 9 comprises a supporting flange 53, and the connection point 13 comprises a hook 55 having a threaded portion 57 removably insertable into a corresponding hole 59 of the supporting flange 53. It is also to be understood that other suitable connection points 13 and means for connecting it to the support bracket 9 may be included according to the present invention, and as also apparent to a person skilled in the art.

Figure 8:
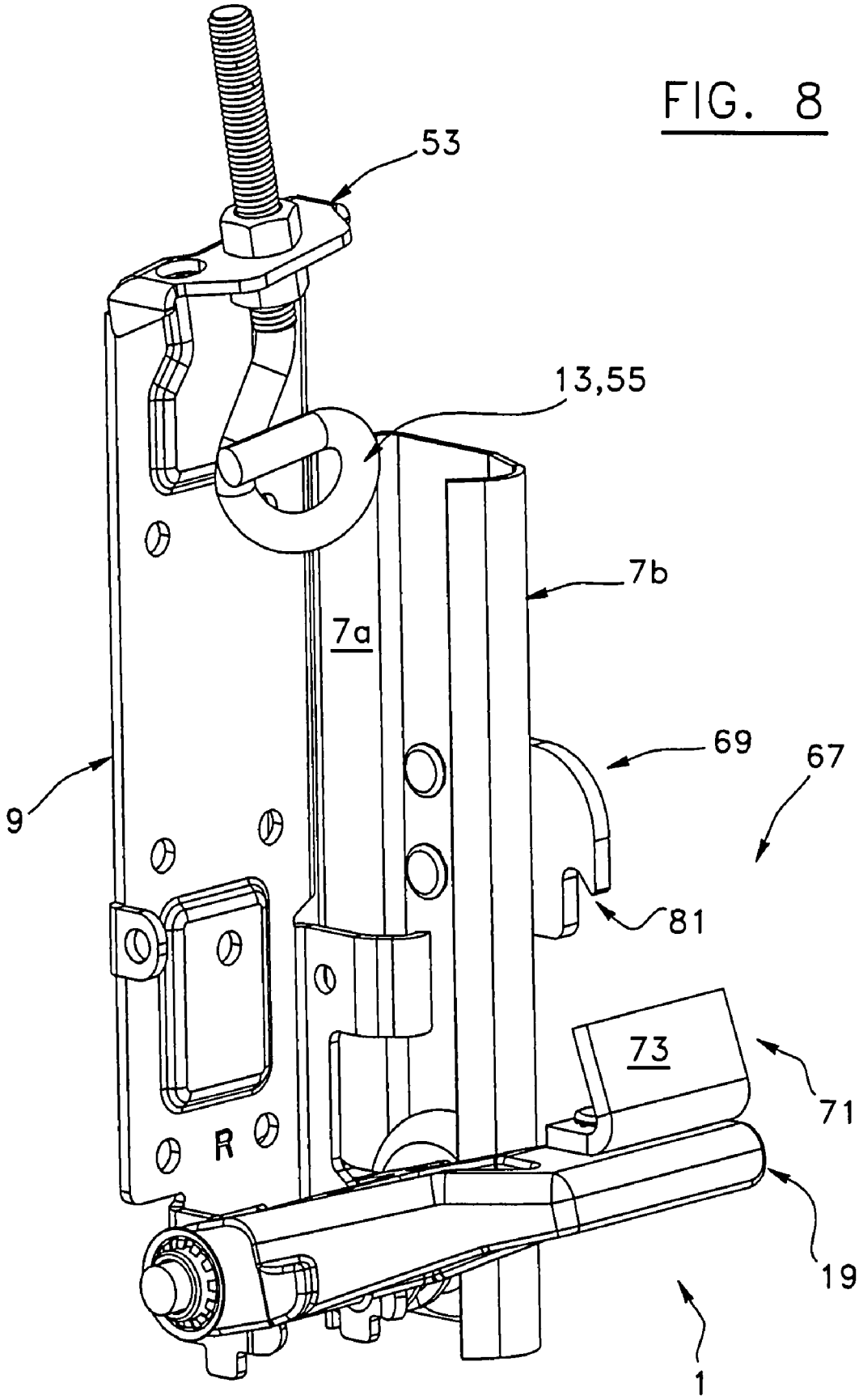
FIG. 8 is a partial perspective view of a brake device with integrated anti-theft mechanism cooperating with a fixed structure according to a preferred embodiment of the present invention.
Figure 9:
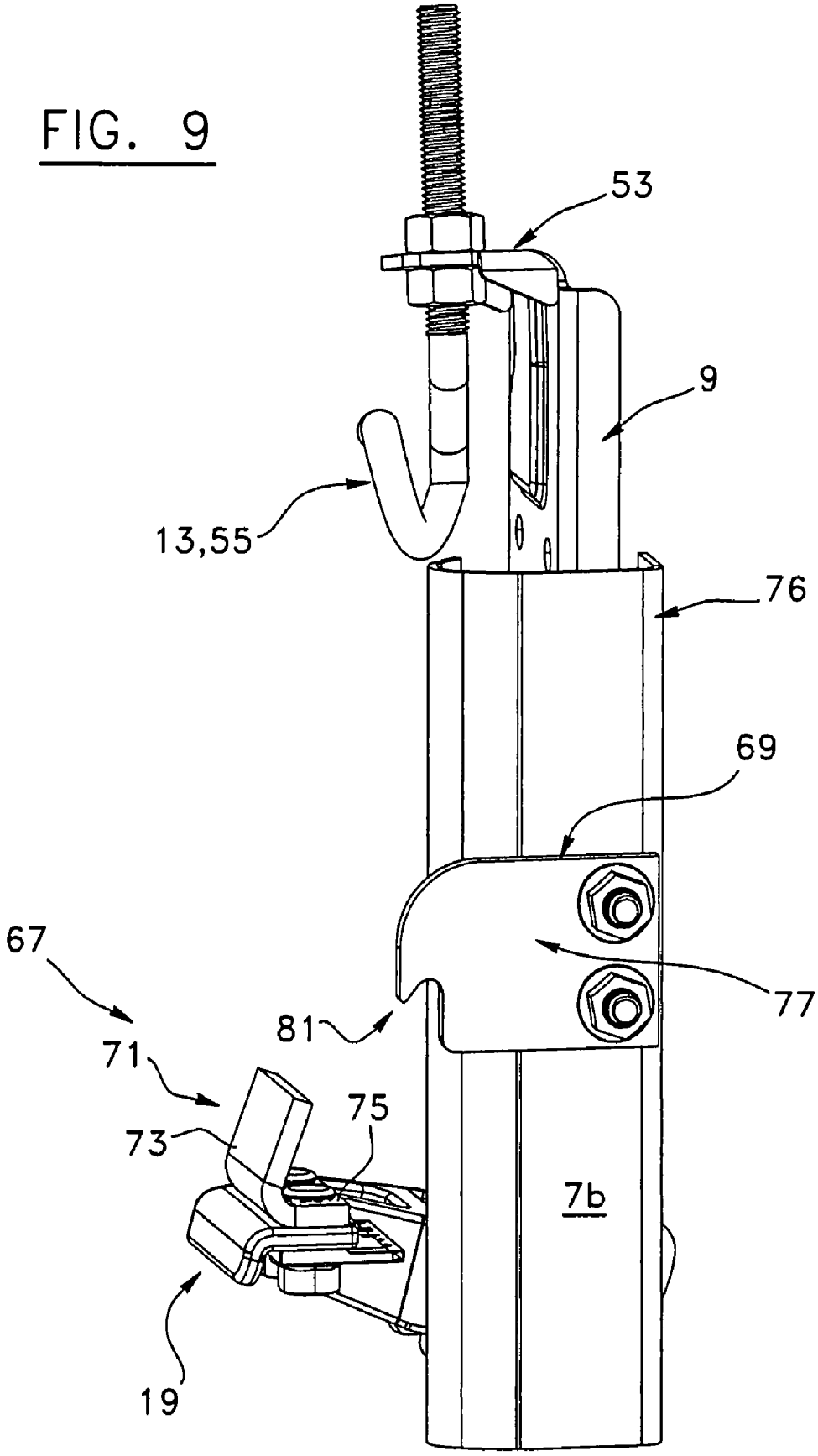
FIG. 9 is a side view of what is shown in FIG. 8, the braking arm and corresponding protrusion being shown in a retracted configuration.

Preferably, and as better shown in FIG. 8, the support bracket 9 comprises at least one embossment 61 for increasing the structural integrity of the support bracket 9.

Figure 10:
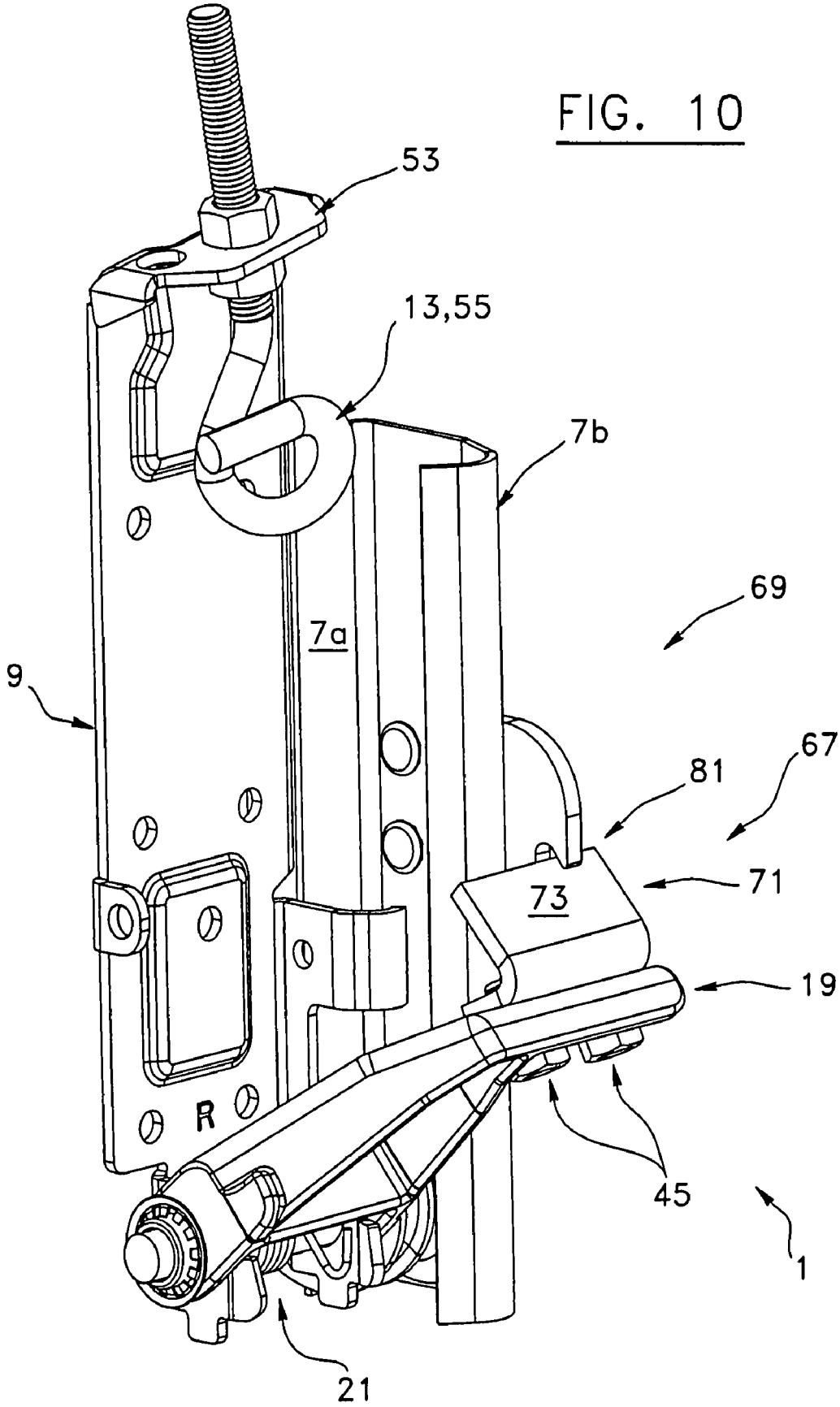
FIG. 10 is another perspective view of what is shown in FIG. 8, the braking arm being now shown in an engaged configuration with its corresponding protrusion engaged into a corresponding catcher assembly so as to prevent upward movement of the brake device and corresponding door.
Figure 11:
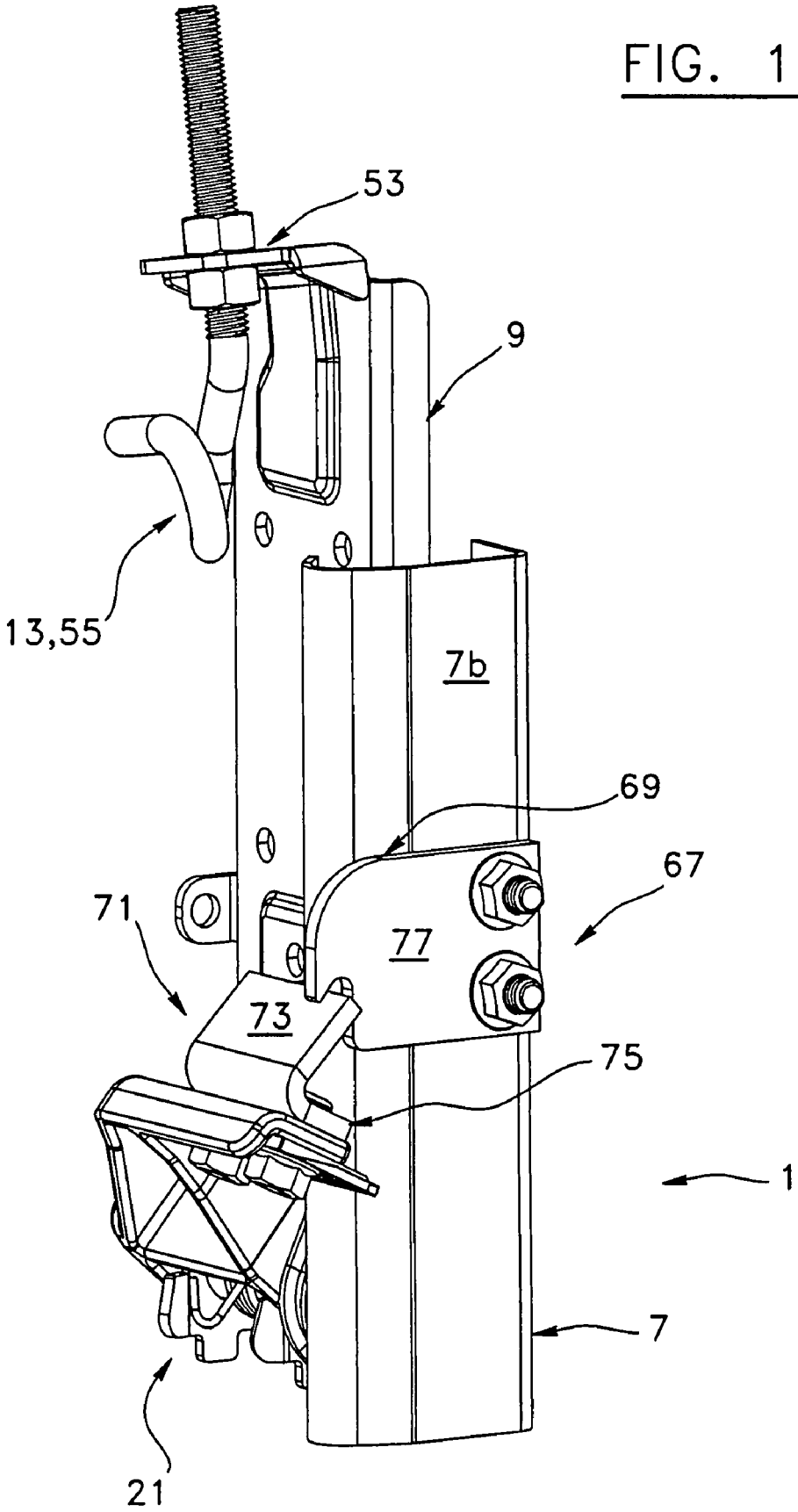
FIG. 11 is another perspective view of what is shown in FIG. 10.

Preferably, and as better shown in FIGS. 10-12, the biasing means 21 comprise a spring 63 having one end operatively connected to the support bracket 9 and another end operatively connected to the braking arm 19 via the hinging portion 33 thereof.

Figure 33:
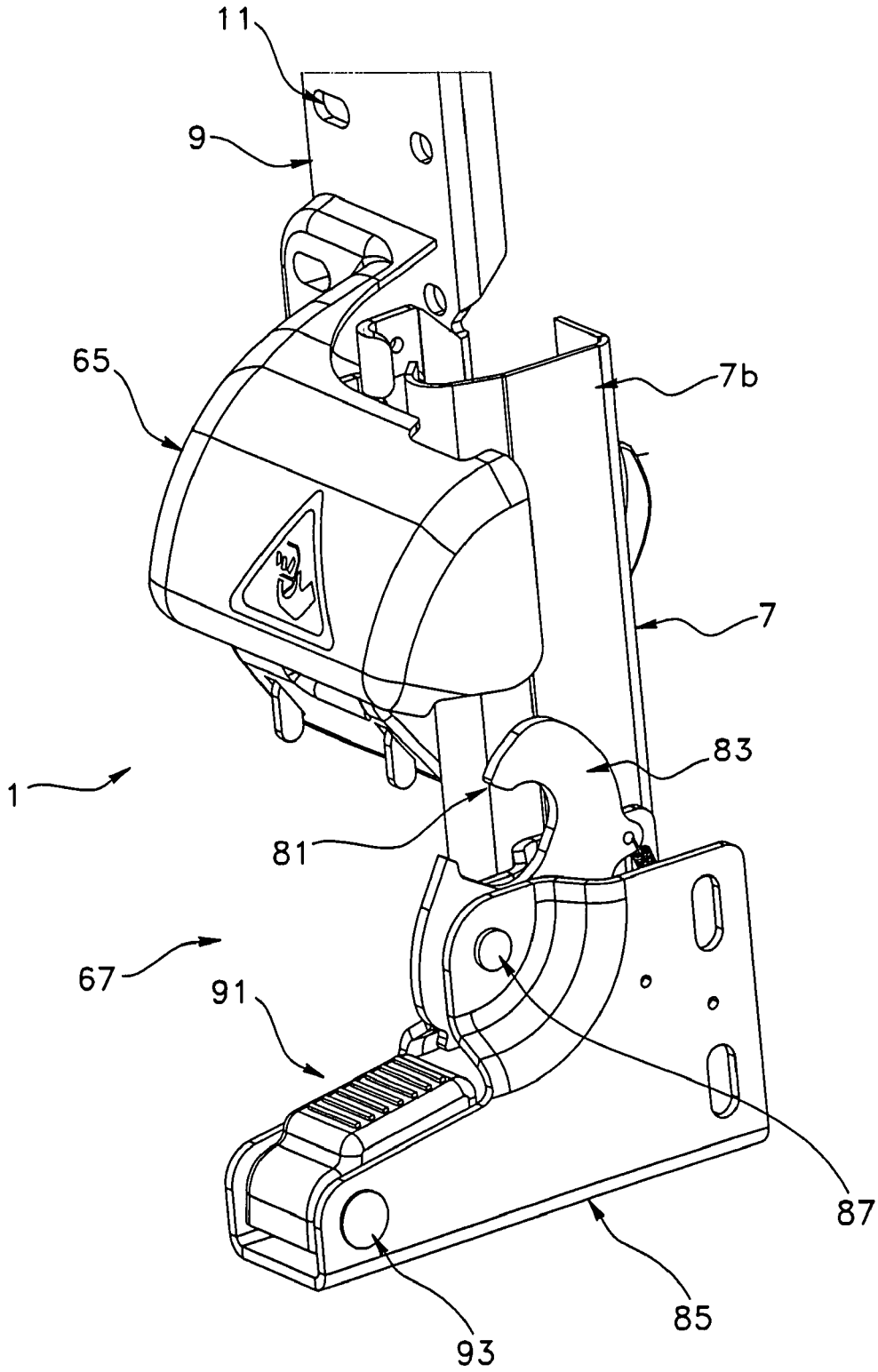
FIG. 33 is a perspective view of a brake device with integrated anti-theft mechanism provided with a protective casing, cooperating with a corresponding fixed structure, as well as with a catcher assembly such as the one shown in FIG. 30.
Figure 34:
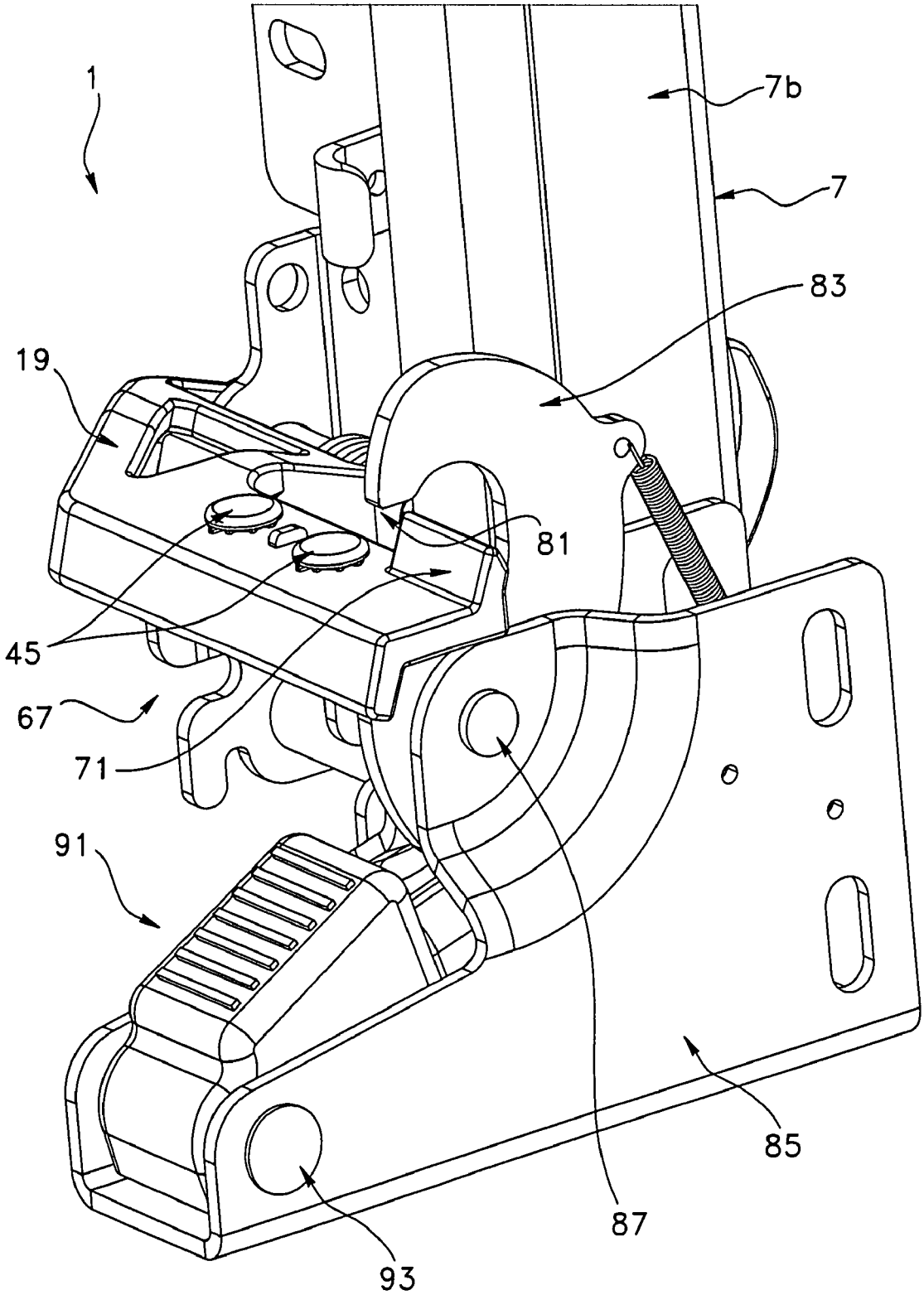
FIG. 34 is an enlarged perspective view of a brake device with integrated anti-theft mechanism cooperating with a catcher assembly according to a preferred embodiment of the present invention.
Figure 35:
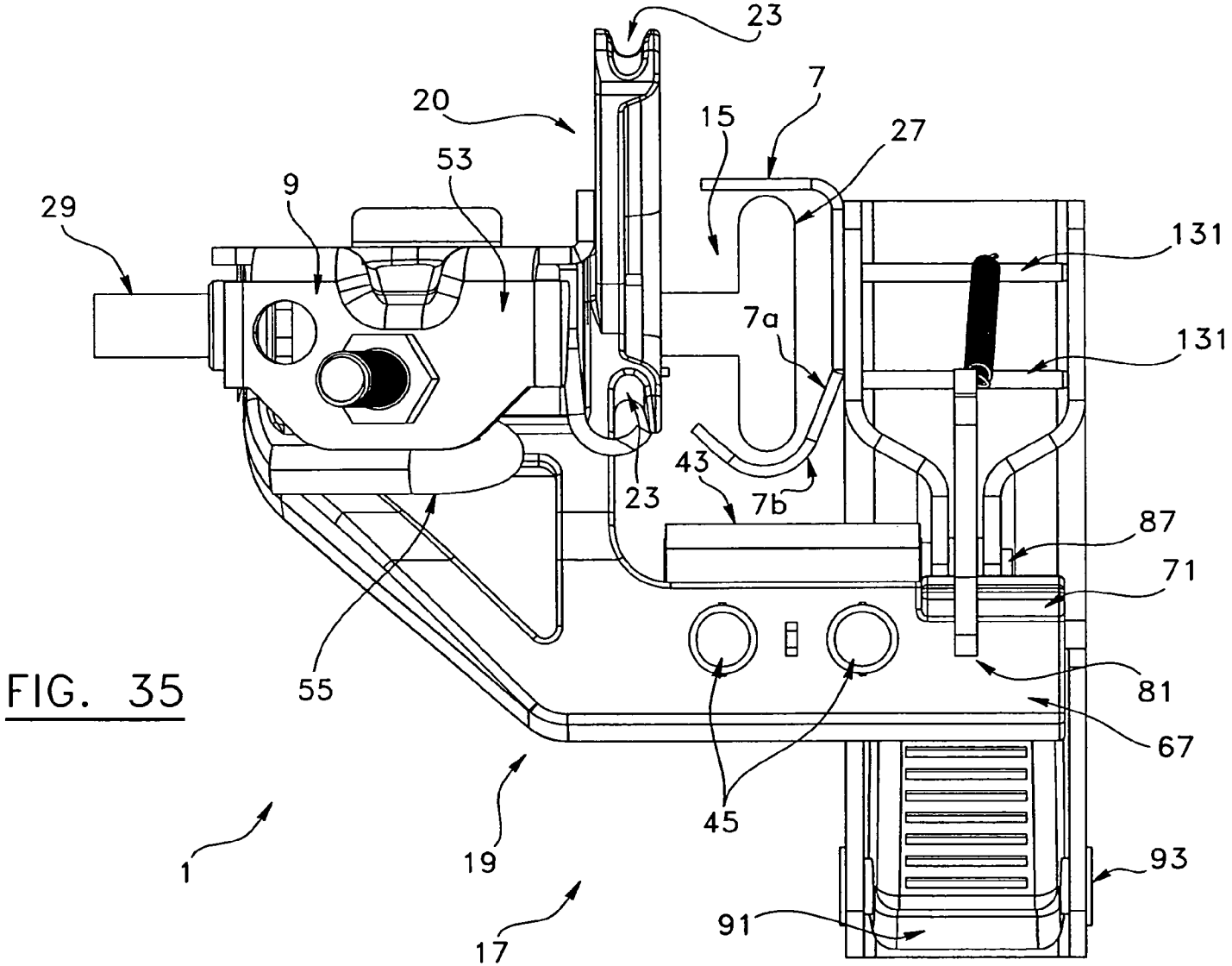
FIG. 35 is a bottom plan view of what is shown in FIG. 34.
Figure 36:
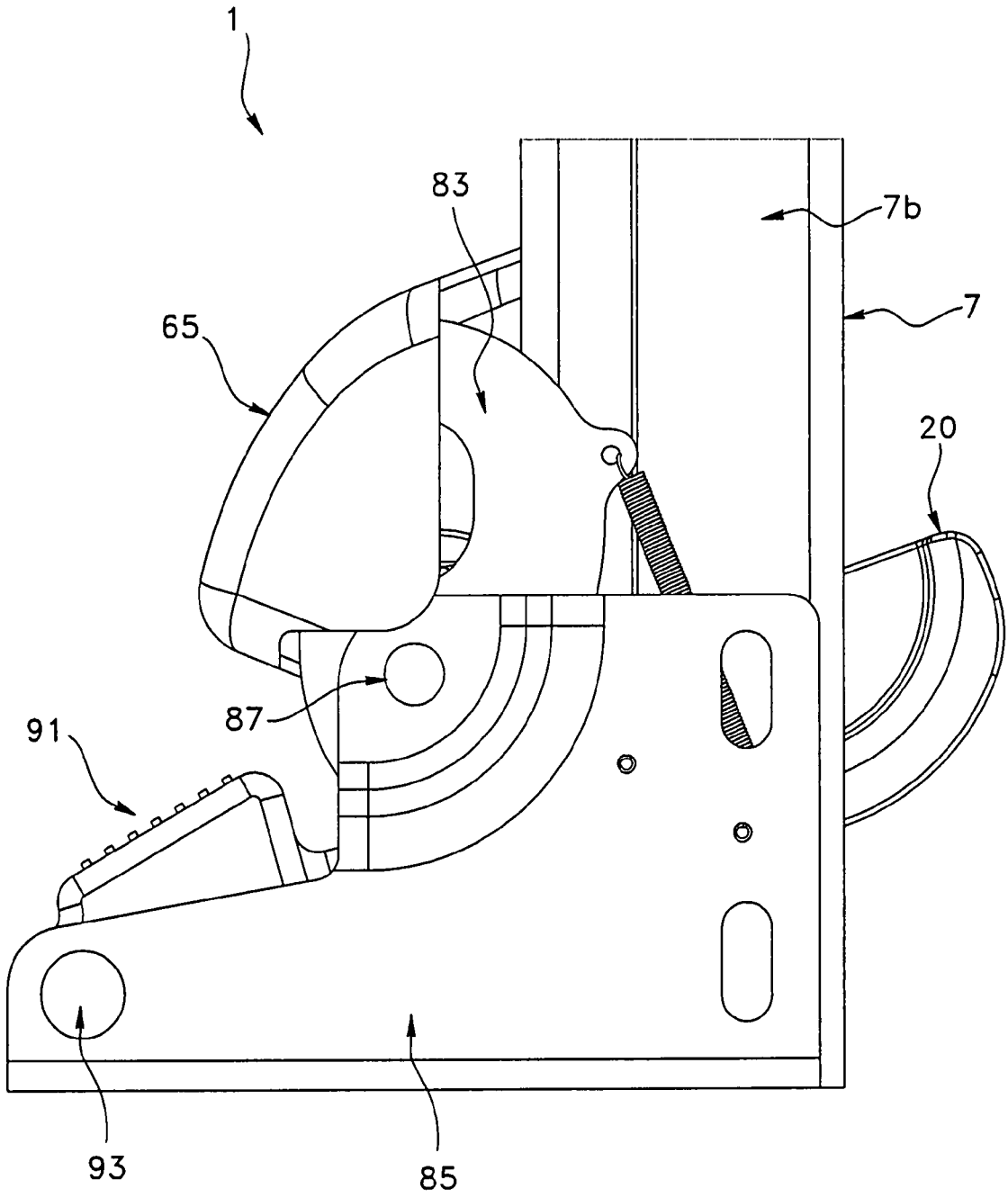
FIG. 36 is a side view of what is shown in FIG. 34, the brake device with integrated anti-theft mechanism being now shown provided with a protective casing.
Figure 37:
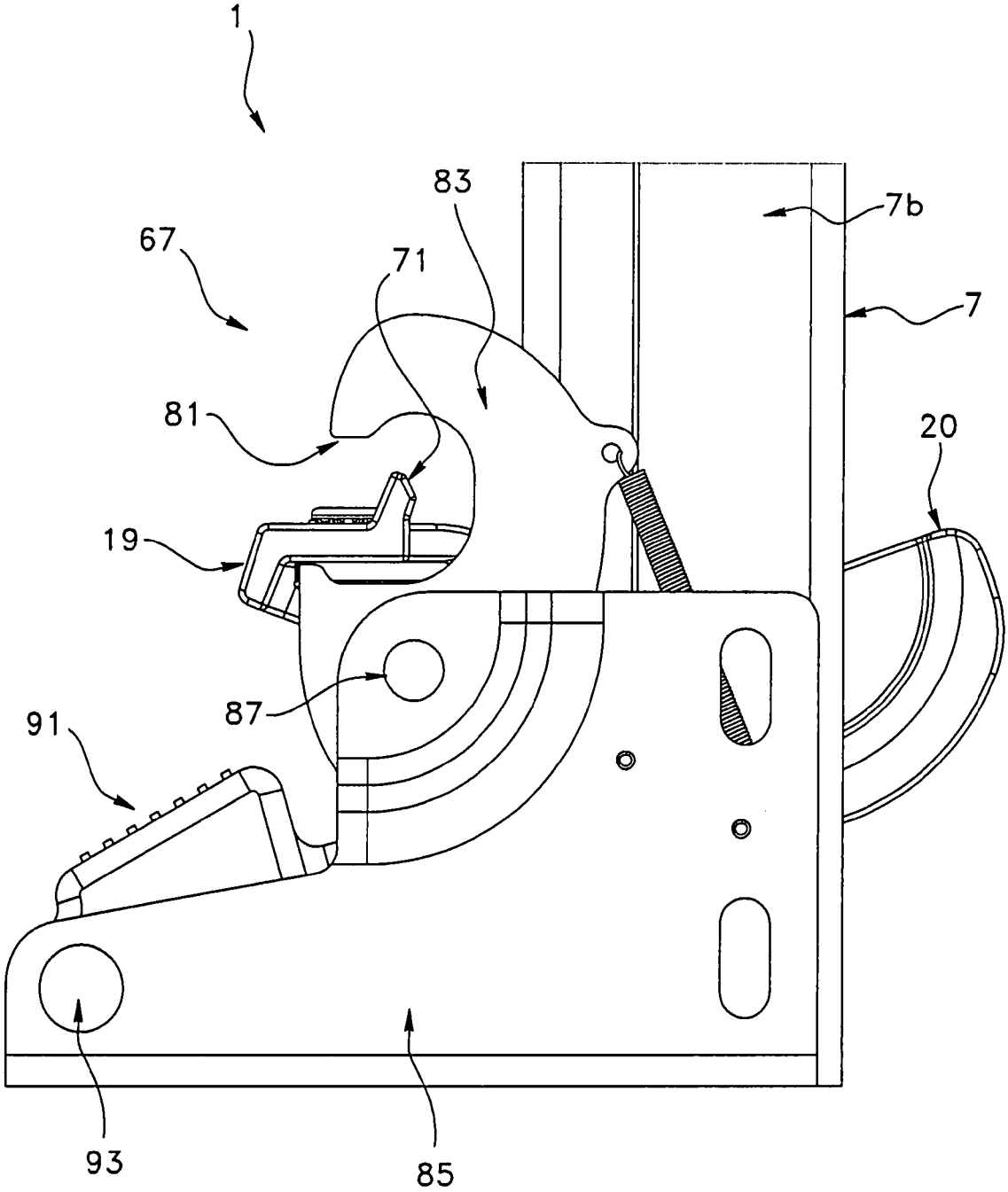
FIG. 37 is another side view of what is shown in FIG. 36 without the protective casing so as to better illustrate cooperation of the catcher lock of the catcher assembly with the protrusion of the braking arm.
Figure 38:
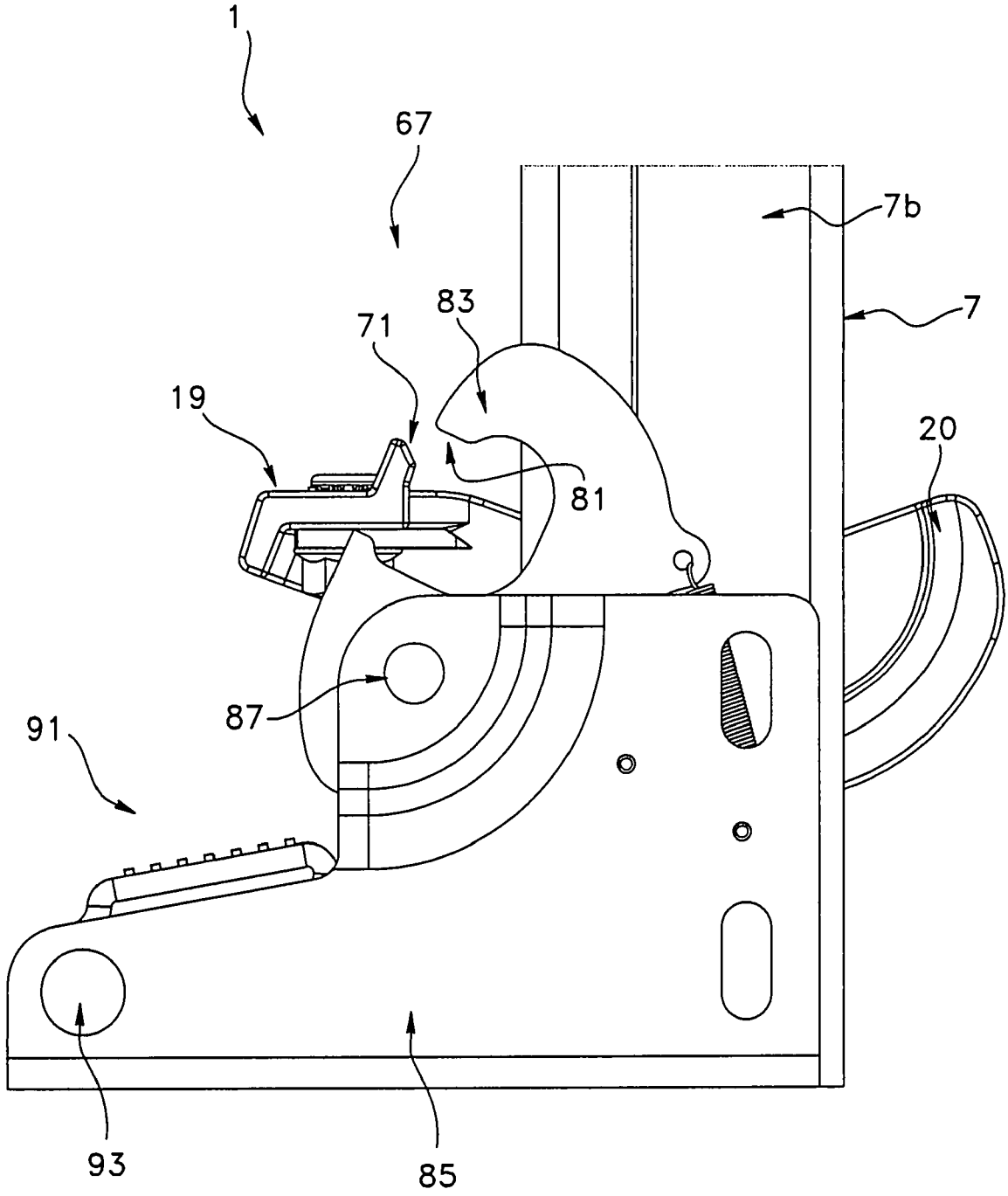
FIG. 38 is another side view of what is shown in FIG. 37, the braking arm with protrusion and the catcher lock of the catcher assembly being shown in another configuration.
Figure 39:
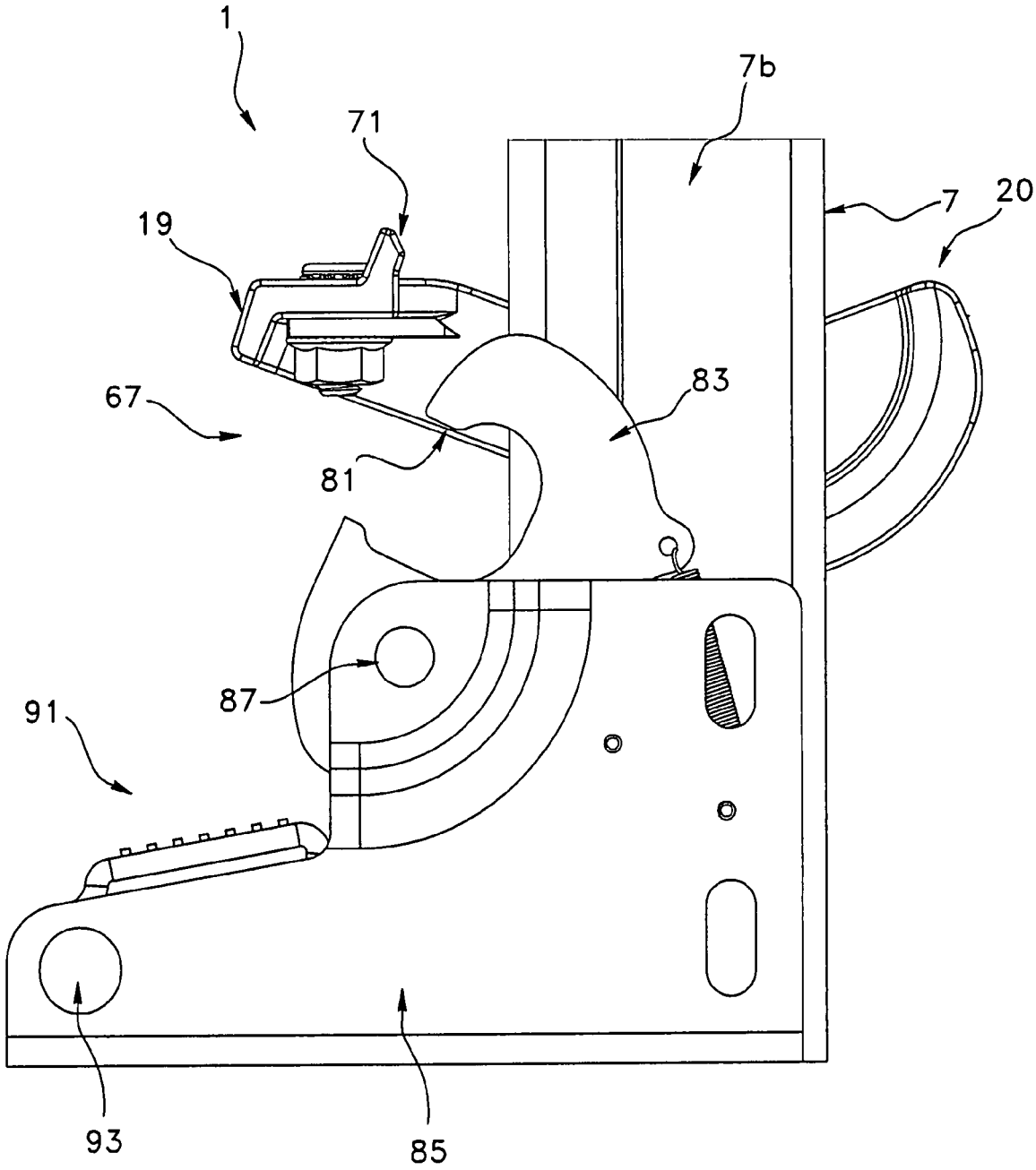
FIG. 39 is another side view of what is shown in FIG. 38, the braking arm with protrusion and the catcher lock of the catcher assembly being shown in another configuration.
Figure 40:
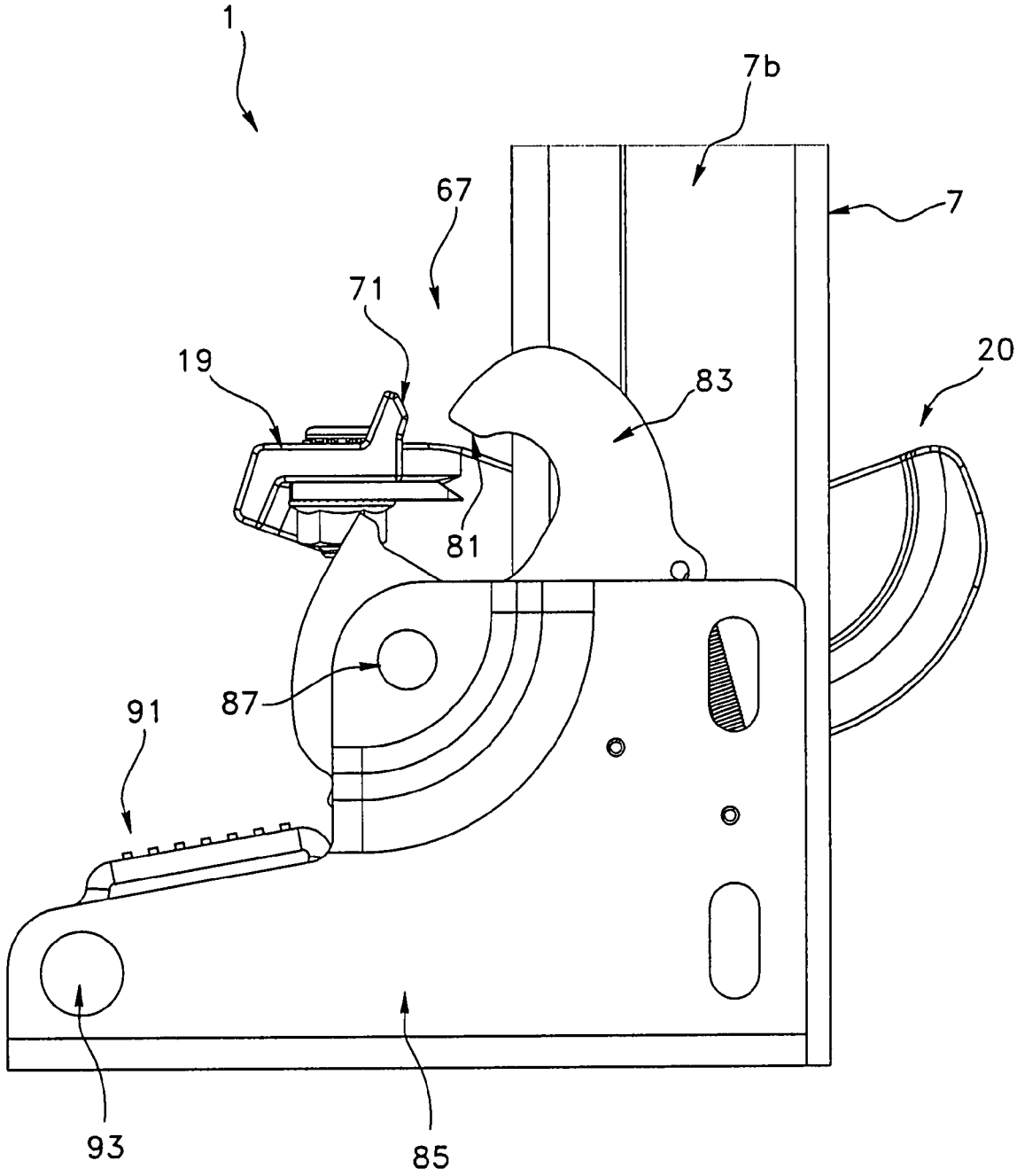
FIG. 40 is another side view of what is shown in FIG. 39, the braking arm with protrusion and the catcher lock of the catcher assembly being shown in another configuration.

Preferably, and as better shown in FIG. 33, the brake device 1 comprises a casing 65 removably mountable onto the support bracket 9 for substantially covering the support bracket 9 and other components operatively connected thereto.

As previously explained, the support bracket 9 preferably comprises first and second support arms 25, and the guiding assembly 15 preferably comprises a roller 27 mounted about a shaft 29, the shaft 29 being mounted onto the first and second support arms 25 of the support bracket 9. It is worth mentioning that the roller 27 may be pivotally mounted about the shaft 29, and that said shaft 29 may be made integral to the support bracket 9, but preferably, the shaft 29 is pivotally mounted onto the support arms 25 and the roller 27 is securely mounted about said shaft 29 (e.g. by press fitting) so that when the shaft 29 rotates, so does the roller 27. However, as apparent to a person skilled in the art, other dispositions between the shaft 29, roller 27, sleeve 31, and support bracket 9, along with other components, may be made so as to enable the roller 27 to properly guide the cable-operated door 3 along the fixed structure 7, without departing from the scope of the present invention.

It is worth mentioning though that several modifications could be made to the present brake device 1 according to the present invention without departing from the scope of the present invention. Indeed, although the biasing means 21 preferably comprise a loaded spring 63, capable of storing potential energy via deformation so as to provide a potential force urging the hinging portion 33, and thus the braking arm 19, towards fixed structure 7 (e.g. rail) and into a braking configuration, in the event of a loss of tension in the cable, it is worth mentioning however that other suitable biasing means 21 which do not use potential energy for providing a biasing force may be used according to the present invention, so long as these biasing means 21 are capable of biasing the braking arm in a suitable way in the manner discussed above, and as apparent to a person skilled in the art.

Moreover, it is worth mentioning that the biasing means 21 may have other suitable dispositions on the brake device 1 so as to ensure a corresponding biasing force on the braking arm 19, via the hinging portion 33 thereof, for example, according to the present invention.

It is worth mentioning also that, according to the present invention, the different various components of the brake device 1 may be disposed otherwise on the support bracket 9, as also apparent to a person skilled in the art.

Referring to FIG. 33, there is shown how the brake device 1 is preferably provided with a casing 65 which is removably mountable onto the support bracket 9 for substantially covering the support bracket 9 and other components operatively connected thereto, such as the support arms 25, the spring 63, the braking arm 19, etc. The casing 65 may be provided with suitable visual information for example, such as the expression "warning" for instance, as illustrated in the figures, or other expressions and/or symbols conveying information.

As can be easily understood from the accompanying drawings, when the braking arm 19 is in the retracted position, the roller 27 of the brake device 1 will guide the door 3 along the rail and the braking arm 19 will travel freely therealong outside the rail. When the braking arm 19 is triggered into the operable position (i.e. braking configuration) by a loss of tension in the cable 5, said loss of tension results in the fact that the cable 5 can no longer push the lever portion 20 of the swivel component 18 and maintain the braking arm 19 away from the fixed structure 7. Namely, the force of the actuating spring 63 becomes greater than the force that was acted upon by the tensioned cable 5 against the braking arm 19 via the lever portion 20, thereby causing the actuating braking arm 19 which is preferably rigidly connected to the hinging portion 33 to rotate the same and thus engage (i.e. anchoring via cutting, notching, etc.) the rail, under the influence of the biasing means 21 (e.g. spring 63), thereby urging the knife 43 against the rail and once anchored therein or engaged thereagainst, preventing and/or slowing down substantially downward movement of the garage door, as apparent to a person skilled in the art. As can be easily understood, this combined action brakes the movement of the cable-operated door 3 and thus reduces the risk of it falling, or at the very least, slow down its descent.

According to another aspect of the present invention, there is also provided a door assembly provided with a brake device 1 such as the one described and illustrated herein.

Figure 4:
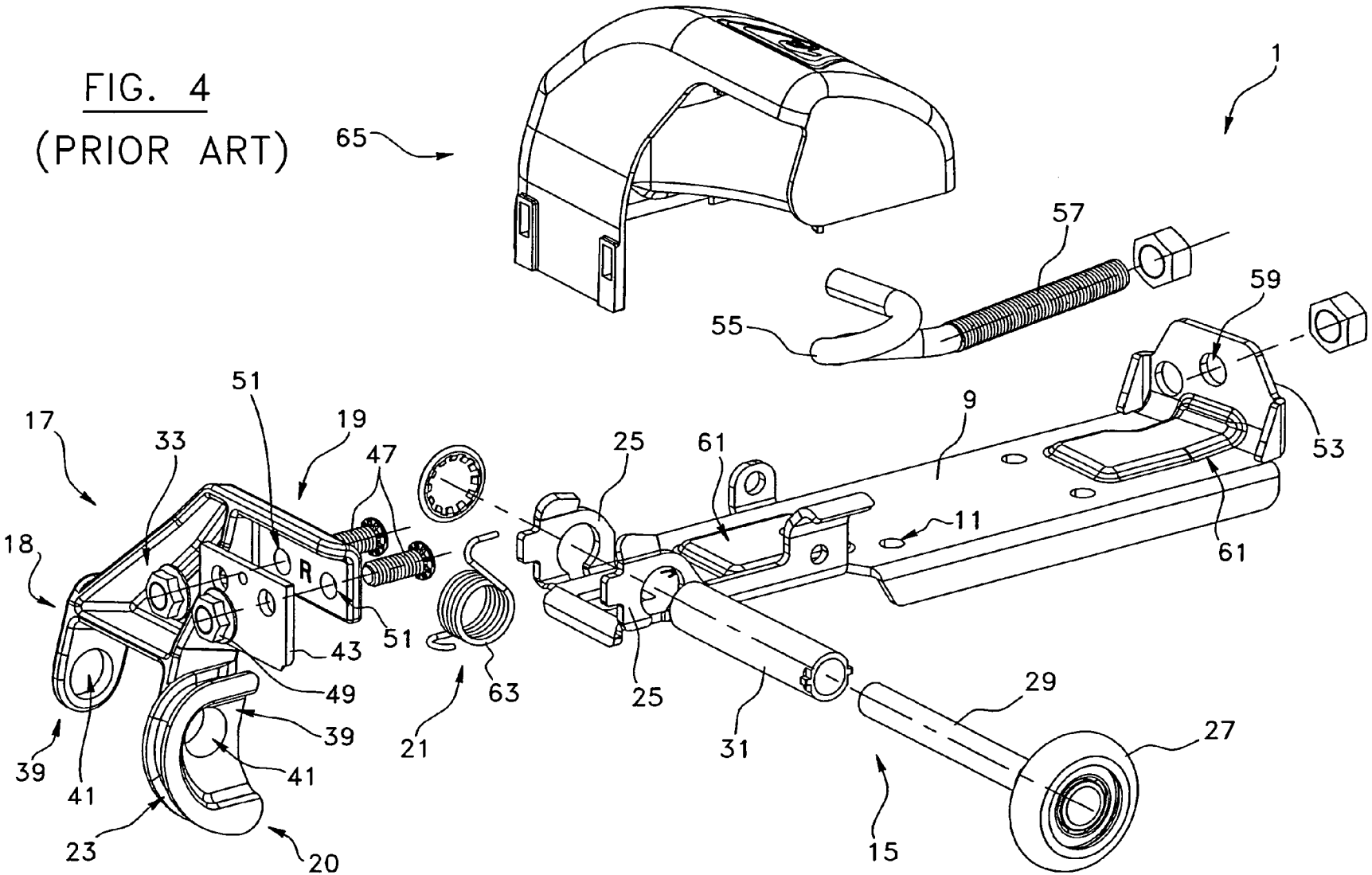
FIG. 4 (PRIOR ART)
FIG. 4 is an exploded view of the brake device shown in FIG. 1.
Figure 5:
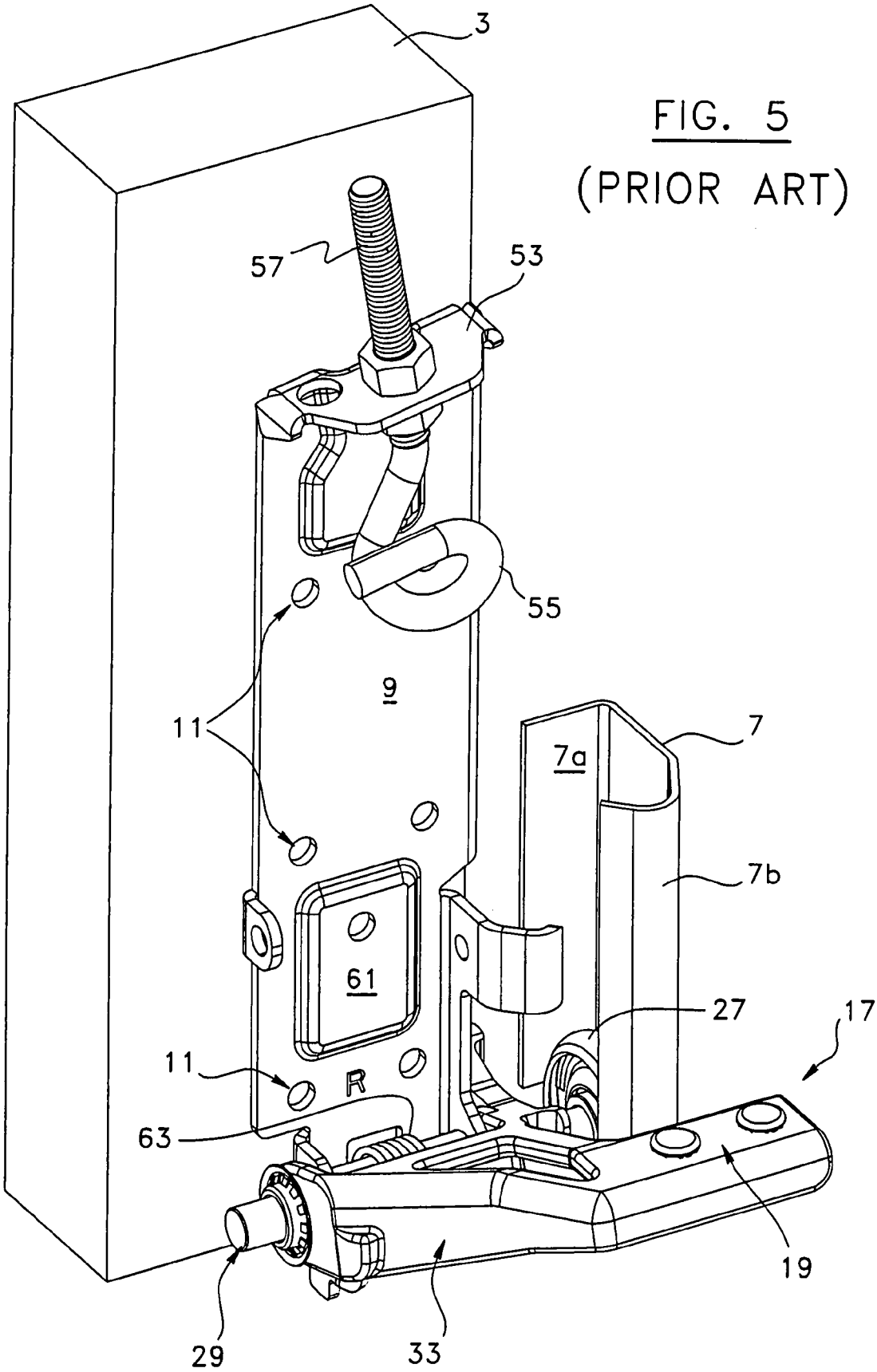
FIG. 5 (PRIOR ART)
FIG. 5 is a partial perspective view of a bottom portion of a door assembly provided with a brake device according to the prior art such as the one shown in FIG. 1, the brake device being shown in a retracted configuration.
Figure 6:
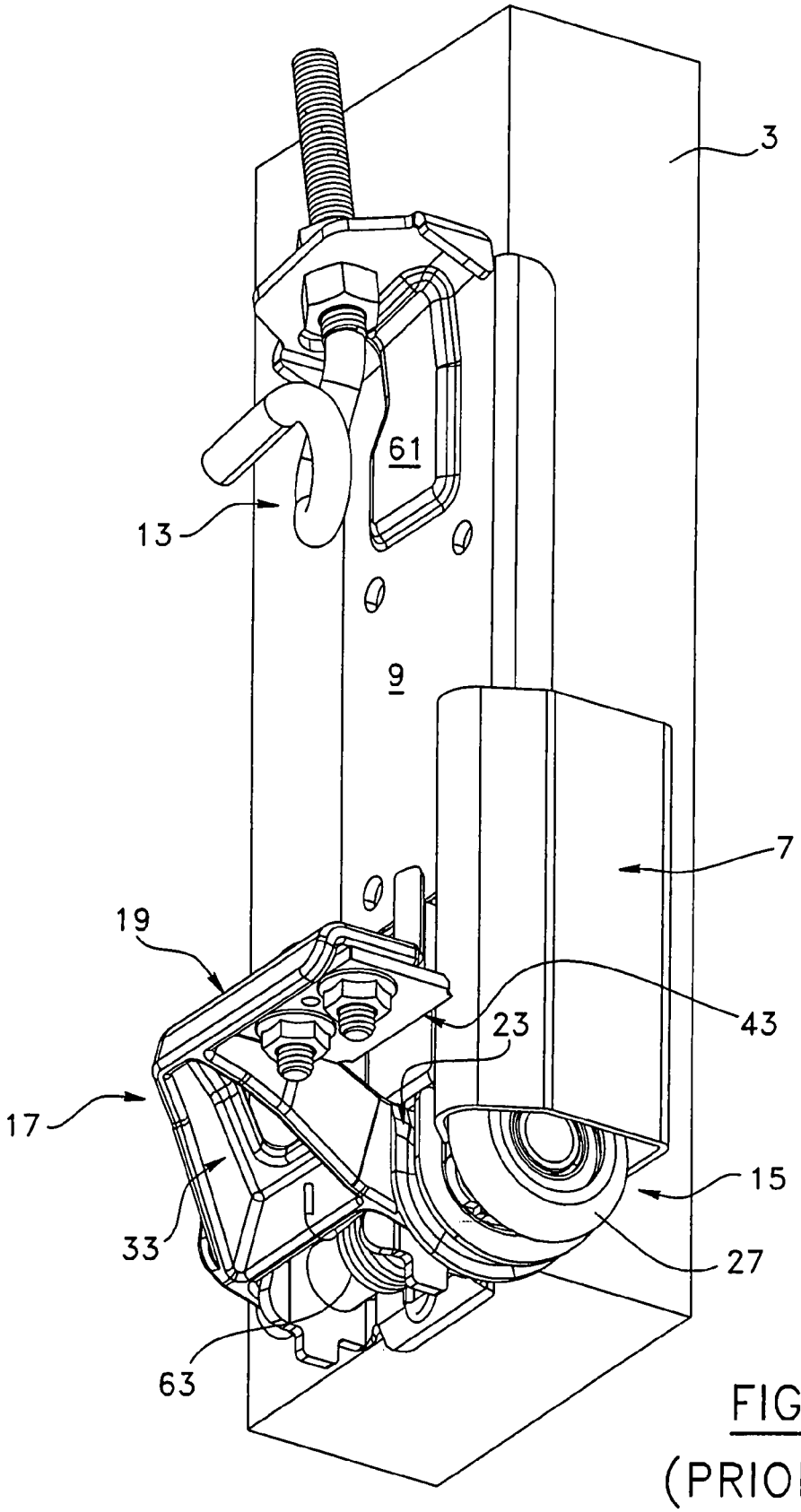
FIG. 6 (PRIOR ART)
FIG. 6 is a bottom perspective view of what is shown in FIG. 5.
Figure 7:
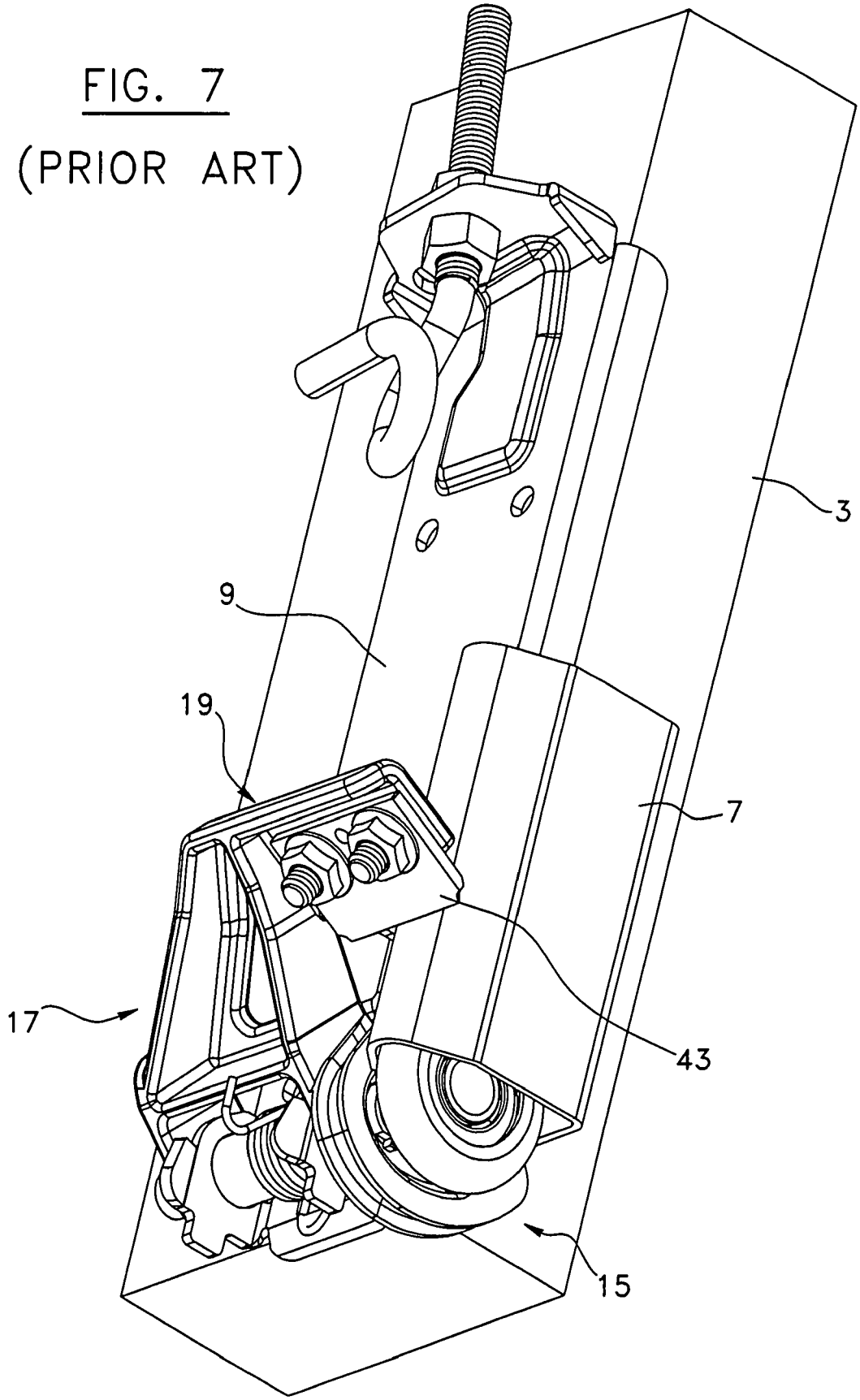
FIG. 7 (PRIOR ART)
FIG. 7 is a partial perspective view of a bottom portion of a door assembly provided with a brake device according to the prior art such as the one shown in FIG. 1, the brake device being shown in a braking configuration, the knife of the braking arm being engaged with the corresponding guide rail.

As may now be better appreciated, the brake device 1 according to the present invention preferably comprises several preventive features. For example, as better shown in FIGS. 1 and 4, the brake device 1 preferably comprises a protective casing 65 removably mountable onto the support bracket 9 by suitable attachment means, for protecting the mechanism of the brake device 1 and for preventing access to the mechanism to the general public (i.e. unskilled users). Moreover, as can be easily understood from the accompanying drawings, the braking arm 19 used with the biasing means 21 of the braking device is preferably shaped, sized and positioned to cut into the side rail when triggered into the braking configuration, so as to stop or, at the very least, slow down the descent of the cable-operated door 3.

Moreover, the device shown in the accompanying figures is a "right" brake device 1 to be located at the bottom of the garage door, more specifically at the right-hand side thereof when viewed from the inside of the garage. A "left" brake device 1, that is, a left-hand side version of the brake device 1 shown, would simply be a mirror image of what is in the accompanying figures.

Furthermore, the present invention is a substantial improvement over the prior art in that, by virtue of its design and components, the brake device 1 is simple and easy to use, as well as is simple and easy to manufacture and/or assemble, without compromising the reliability of its functions. Hence, it may now be appreciated that the present invention represents important advantages over other brake devices known in the prior art, as briefly explained hereinabove.

The present invention is also an improvement and presents several advantages over other brake devices known on the prior art in that it may be used in the garage door industry, with new garage doors or existing garage doors, whether commercial or residential. Indeed, in the case of a cable/spring failure, the present invention is intended to reduce the risk of the door falling, or at the very least slow down the fall of the garage door 3, so as to minimize or even prevent adverse effects which could otherwise occur if the brake device 1 according to the present invention was not present, in addition to offering several anti-theft features, as also briefly explained hereinabove. Furthermore, the present invention may be used with other kinds of doors, such as slidable truck doors, or with any other items suspended by a cable, as apparent to a person skilled in the art.

Of course, numerous modifications could be made to the above-described embodiments without departing from the scope of the invention, as defined the appended claims.

The invention claimed is:

1. A brake device for a cable-operated door operated by a tensioned cable, the cable-operated door having a movement guided along a fixed structure, the fixed structure having an inner portion and an outer portion, the brake device being mountable onto the cable-operated door and being configured for cooperating with the tensioned cable so as to immobilize the cable-operated door with respect to the fixed structure in the event of a loss of tension in the cable, the brake device comprising:

a support bracket mountable onto a bottom portion of the cable-operated door, the support bracket comprising:

at least one hole for receiving each a corresponding fastener for securely mounting the support bracket onto the cable-operated door; and a connection point onto which an extremity of the tensioned cable is connected;

a guiding assembly operatively mounted onto the support bracket for travelling along the inner portion of the fixed structure so as to guide the movement of the cable-operated door along said fixed structure when the support bracket is mounted onto the bottom portion of the cable-operated door;

a braking assembly operatively mounted onto the support bracket for cooperating with the tensioned cable, the braking assembly comprising a swivel component pivotably mounted and movable about the support bracket, the swivel component having opposite first and second ends, the first end being provided with a braking arm, and the second end being provided with a lever portion positioned, shaped and sized about the support bracket for cooperating with the tensioned cable, the braking arm projecting out from the support bracket for positioning of said braking arm adjacent to the outer portion of the fixed structure, the braking arm being operable between a retracted configuration, where the braking arm is urged away from the fixed structure via a frictional engagement of the tensioned cable against the lever portion opposite to the braking arm on the swivel component, so as to allow the guiding assembly to guide the cable-operated door freely along the fixed structure, and an engaged configuration, caused by a given loss of tension in the cable resulting in a decrease of frictional engagement of the cable with the lever portion, where the braking arm is no longer urged away and thereby engages a portion of the outer portion of the fixed structure for braking movement of the cable-operated door with respect to the fixed structure;

biasing means operatively connected between the support bracket and the braking assembly for biasing the braking arm into an engaged configuration; and a guiding channel defined within the lever portion of the swivel component for guiding the tensioned cable about the braking assembly and onto the connection point of the support bracket;

the improvement wherein the brake device is provided with an anti-theft mechanism comprising:

a catcher assembly operatively connectable to the fixed structure, the catcher assembly comprising a component removably mountable onto the outer portion of the fixed structure via at least one fastener; and a protrusion operatively projecting from the braking arm, the protrusion been shaped, positioned and sized with respect to the catcher assembly so as to be engaged with said catcher assembly when the braking arm is operated into the engaged configuration caused by a given loss of tension in the cable, thereby preventing the cable-operated door from being displaced upwardly along the fixed structure as a result of the catcher assembly abutting against the protrusion of the braking arm.

2. A brake device according to claim 1, wherein the protrusion of the braking arm is a component being removably mountable onto said braking arm via at least one fastener.

3. A brake device according to claim 1, wherein the protrusion of the braking arm is a substantially V-shaped component having first and second flanges, and wherein the second flange of the protrusion is removably mountable onto the braking arm via at least one fastener.

4. A brake device according to claim 1, wherein the protrusion of the braking arm is made integral to said braking arm.

5. A brake device according to claim 1, wherein the catcher assembly comprises a hooking portion for engaging a corresponding projecting portion of the protrusion of the braking arm.

6. A brake device according to claim 1, wherein the catcher assembly comprises a catcher lock being operatively mounted onto the fixed structure in a rocking manner, the catcher lock being configured so as to be rocked between a released configuration where a hooking portion of the catcher lock is positioned away from the protrusion of the braking arm thereby enabling the cable-operated door to be displaced along the fixed structure, and a hooked configuration where the hooking portion of the catcher lock is engaged against the protrusion of the braking arm thereby preventing the cable-operated door from being displaced upwardly along the fixed structure as a result of the hooking portion of the catcher lock abutting against the protrusion of the braking arm.

7. A brake device according to claim 6, wherein the catcher lock is operatively mounted onto the fixed structure by means of a housing being removably connectable to said fixed structure, the catcher lock being pivotably mounted onto the housing by means of a lock pivot, and the catcher lock being spring-loaded by means of a spring operatively connected between the catcher lock and the housing.

8. A brake device according to claim 7, wherein the catcher assembly further comprises a pedal being pivotably mounted onto the housing by means of a pedal pivot, the pedal being provided with an actuation end shaped, positioned and sized for cooperating with and actuating a corresponding receiving portion of the catcher lock.

9. A brake device according to claim 8, wherein the pedal is spring-loaded by means of a spring having one end operatively connected to the pedal and another end operatively connected to the housing.

10. A brake device according to claim 1, wherein the support bracket comprises a pair of main support arms and wherein the guiding assembly comprises a roller mounted about a shaft, said shaft being rotatably mounted about said main support arms.

11. A brake device according to claim 10, wherein the support bracket comprises a pair of additional support arms positioned below the main support arms, and wherein the shaft of the roller of the guiding assembly is selectively mountable about said additional support arms for selectively lowering positioning of the roller with respect to the support bracket.

12. A brake device according to claim 11, wherein the guiding assembly comprises a sleeve rotatably mounted about the support arms, and wherein the shaft of the roller is further rotatably mounted within the sleeve.

13. A brake device according to claim 1, wherein the catcher assembly comprises a component having a breakable section projecting outwardly from the catcher assembly for cooperating with the protrusion of the braking arm, the breakable section defining a recess being complementary in shape to said protrusion for facilitating positioning of the catcher assembly with respect to the protrusion of the braking arm, the breakable section being removable from the catcher assembly upon installation.

14. A brake device according to claim 1, wherein the brake device comprises a stopper arm pivotably mounted and movable about the support bracket, the stopper arm having a first end pivotably connected to the support bracket and a second end for cooperating with the braking arm, the stopper arm being positioned, shaped and sized so that its second end abuts against the braking arm upon an orientation of the support bracket at a given angle θ with respect to the fixed structure so as to prevent rotation of the swivel component and thus prevent the braking arm from being operated into the engaged configuration.

15. A brake device according to claim 1, wherein the connection point is adjustably displaceable with respect to the support bracket.

16. A brake device according to claim 15, wherein the connection point is operatively connected to a spring so as to provide the brake device with a spring-loaded connection point.

17. A brake device according to claim 1, wherein the support bracket comprises first and second supports, for receiving an adjustment bolt having a shaft provided with a corresponding head, the shaft extending through the first and second supports, and the head of the adjustment bolt being biased away from the second support via a spring extending between said head of the adjustment bolt and the second support, the connection point being mounted onto a block threadedly engaged with the shaft of the adjustment bolt so as to be displaced therealong via a rotation of said adjustment bolt.

18. A brake device according to claim 17, wherein a tip of the shaft is provided with a clip positioned adjacent and outwardly from the first support of the support bracket for preventing the tip of the shaft from being removed from said first support.

19. A brake device according to claim 1, wherein the braking arm has a hinging portion pivotably mounted about a sleeve of the brake device.

20. A brake device according to claim 19, wherein the hinging portion comprises a pair of hinging flanges each having a corresponding orifice for the sleeve to pass therethrough.

21. A brake device according to claim 20, wherein the guiding channel is operatively connected to the hinging portion of the braking arm.

22. A brake device according to claim 21, wherein the guiding channel is made integral to the hinging portion of the braking arm.

23. A brake device according to claim 1, wherein the braking arm is provided with a knife having an edge extending from the braking arm for engaging with the outer portion of the fixed structure when in the engaged configuration.

24. A brake device according to claim 23, wherein the knife is removably mounted onto the braking arm with at least one fastener.

25. A brake device according to claim 24, wherein said at least one fastener comprises a pair of fasteners each comprising a bolt and a corresponding nut, each bolt being insertable through a corresponding hole provided along the braking arm.

26. A brake device according to claim 1, wherein the support bracket comprises a supporting flange, and wherein the connection point comprises a hook having a threaded portion removably insertable into a corresponding hole of the supporting flange.

27. A brake device according to claim 1, wherein the support bracket comprises at least one embossment for increasing the structural integrity of the support bracket.

28. A brake device according to claim 1, wherein the biasing means comprise a spring having one end operatively connected to the support bracket and another end operatively connected to the braking arm via a hinging portion thereof.

29. A brake device according to claim 1, wherein the brake device comprises a casing removably mountable onto the support bracket for substantially covering the support bracket and other components operatively connected thereto.

* * * * *